US007762494B2

(12) United States Patent
Sawai

(10) Patent No.: US 7,762,494 B2
(45) Date of Patent: Jul. 27, 2010

(54) IMAGE GENERATING APPARATUS

(75) Inventor: Kunio Sawai, Daito (JP)

(73) Assignee: Funai Electric Co., Ltd., Daito-shi (JP)

( * ) Notice: Subject to any disclaimer, the term of this patent is extended or adjusted under 35 U.S.C. 154(b) by 273 days.

(21) Appl. No.: 11/972,319

(22) Filed: Jan. 10, 2008

(65) Prior Publication Data

US 2008/0169371 A1 Jul. 17, 2008

(30) Foreign Application Priority Data

Jan. 12, 2007 (JP) ..... 2007-004006

(51) Int. Cl.
*B65H 16/06* (2006.01)

(52) U.S. Cl. ..... 242/599.2; 242/599.3; 242/599.4; 400/641

(58) Field of Classification Search ..... 242/376, 242/376.1, 571.8, 599.2–599.4, 129.51; 400/641, 400/629, 636; 347/218
See application file for complete search history.

(56) References Cited

U.S. PATENT DOCUMENTS

| | | | | |
|---|---|---|---|---|
| 5,141,217 | A * | 8/1992 | Lim et al. | 271/10.13 |
| 5,738,453 | A * | 4/1998 | Tsuburaya et al. | 400/624 |
| 7,267,502 | B2 * | 9/2007 | Sawai | 400/641 |
| 2006/0048498 | A1 | 3/2006 | Takasaka et al. | |

FOREIGN PATENT DOCUMENTS

| | | | |
|---|---|---|---|
| JP | 5-106641 | A | 4/1993 |
| JP | 7-229524 | A | 8/1995 |
| JP | 7-269589 | A | 10/1995 |
| JP | 10-243606 | A | 9/1998 |
| JP | 2005-199520 | A | 7/2005 |
| JP | 2005186451 | A * | 7/2005 |
| JP | 2005-344858 | A | 12/2005 |
| JP | 2005349724 | A * | 12/2005 |
| JP | 2006051779 | A * | 2/2006 |
| JP | 2006-076127 | A | 3/2006 |

OTHER PUBLICATIONS

Japanese Office Action dated Jan. 6, 2009 with English translation (four (4) pages).

* cited by examiner

*Primary Examiner*—Sang Kim
(74) *Attorney, Agent, or Firm*—Crowell & Moring, LLP

(57) ABSTRACT

An image generating apparatus capable of stably taking up an ink sheet on a take-up bobbin with proper tensile force by performing proper torque control on the take-up bobbin is obtained. This image generating apparatus comprises a driving source transporting an ink sheet of an ink sheet cartridge and a take-up reel transmitting the driving force of the driving source to a take-up bobbin of the ink sheet cartridge and taking up the ink sheet on the take-up bobbin, while the take-up reel includes a reel member, integrally provided with a plurality of fragment portions concentrically with the rotation axis thereof, engaging with the take-up bobbin, a driving-side gear member fitted with the outer peripheral surfaces of the fragment portions of the reel member and a spring member press-fitted with the inner peripheral surfaces of the fragment portions of the reel member thereby bringing the fragment portions into pressure contact with the driving-side gear member.

16 Claims, 10 Drawing Sheets

IMAGE GENERATING APPARATUS

BACKGROUND OF THE INVENTION

1. Field of the Invention

The present invention relates to an image generating apparatus comprising a take-up reel taking up an ink sheet on a take-up bobbin.

2. Description of the Background Art

A torque limiter mechanism applied to an image generating apparatus or the like comprising a take-up reel taking up an ink sheet on a take-up bobbin is known in general, as disclosed in each of Japanese Patent Laying-Open Nos. 2005-344858, 7-269589 (1995), 5-106641 (1993), 7-229524 (1995) and 2005-199520, for example.

The aforementioned Japanese Patent Laying-Open No. 2005-344858 discloses a torque limiter comprising a rotating cylindrical housing and an inner race including a plurality of torque limiting members integrally having deflectable elastic portions annularly provided on the outer peripheral surface thereof. In the torque limiter described in Japanese Patent Laying-Open No. 2005-344858, the torque limiting members of the inner race fitted with the inner peripheral surface of the housing coaxially with the housing slidably come into contact with the inner peripheral surface of the housing while applying prescribed pressing force in a direction expanding the inner diameter.

The aforementioned Japanese Patent Laying-Open No. 7-269589 discloses a torque limiter constituted of a power output member including a flange portion having a first end surface annularly provided with a plurality of deflectable engaging portions at a constant interval and a second end surface connectable with an output shaft, a power input member including a flange portion having a first end surface connectable with a driving shaft of a driving source and a friction member wound on and fixed to the outer peripheral surface of a small-diametral portion axially extending from a second end surface of the flange portion and a torsion coil spring fitted with the outer peripheral surfaces of the engaging portions of the power output member as well as a paper feeder and an office machine each employing this torque limiter. In the torque limiter as well as the paper feeder and the office machine each employing this torque limiter described in Japanese Patent Laying-Open No. 7-269589, the small-diametral portion of the power input member and the outer peripheral surfaces of the engaging portions of the power output member are fitted with each other through the friction member while the outer peripheral surfaces of the engaging portions of the power output member are clamped by the torsion coil spring toward the axial center, to slidably come into contact with the friction member fixed to the small-diametral portion of the power input member while applying prescribed pressing force.

The aforementioned Japanese Patent Laying-Open No. 5-106641 discloses a torque limiter comprising a rotating cylindrical outer race, a cylindrical inner race rotatable inside the outer race and a coil spring fitted between the inner and outer races and integrally provided with a large-diametral coil portion and a small-diametral coil portion. In the torque limiter described in Japanese Patent Laying-Open No. 5-106641, the large-diametral coil portion of the coil spring fitted with the inner peripheral surface of the outer race slidably comes into contact with the inner peripheral surface of the outer race while applying prescribed pressing force to the inner peripheral surface of the outer race in a direction expanding the inner diameter while the small-diametral coil portion of the coil spring fitted with the outer peripheral surface of the inner race slidably comes into contact with the outer peripheral surface of the inner race while applying prescribed pressing force to the outer peripheral surface of the inner race in a direction reducing the outer diameter.

The aforementioned Japanese Patent Laying-Open No. 7-229524 discloses a bidirectional torque limiter comprising a rotating cylindrical outer tube, a cylindrical inner tube provided with a spring storage portion and rotatable inside the outer tube and a coil spring fitted between the inner and outer tubes and integrally provided with clockwise and counterclockwise coil portions linked with each other. In the bidirectional torque limiter described in Japanese Patent Laying-Open No. 7-229524, the counterclockwise coil portion of the coil spring fitted with the inner peripheral surface of the outer tube slidably comes into contact with the inner peripheral surface of the outer tube while applying prescribed pressing force to the inner peripheral surface of the outer tube in a direction for expanding the inner diameter while the clockwise coil portion of the coil spring fitted with the spring storage portion of the inner tube slidably comes into contact with the spring storage portion of the inner tube while applying prescribed pressing force to the inner peripheral surface of the spring storage portion of the inner tube in a direction for expanding the inner diameter.

The aforementioned Japanese Patent Laying-Open No. 2005-199520 discloses a ribbon take-up mechanism (torque limiter mechanism) constituted of a cylindrical bobbin gear provided with a gear portion on a prescribed position of the outer periphery thereof, a bobbin shaft mounted with a take-up bobbin and a close-coiled spring fitted with the outer peripheral surface of a shaft portion of the bobbin gear. In the ribbon take-up mechanism (torque limiter mechanism) described in Japanese Patent Laying-Open No. 2005-199520, the close-coiled spring clamps the outer peripheral surface of the shaft portion of the bobbin gear toward the center of the rotation axis, thereby providing prescribed clamping force to the bobbin shaft slidably coming into contact with the inner peripheral surface of the shaft portion of the bobbin gear.

In the conventional torque limiter proposed in the aforementioned Japanese Patent Laying-Open No. 2005-344858, however, the torque limiting members regularly generating the pressing force toward the inner peripheral surface of the housing are integrally formed on the inner race. Depending on the material of the inner race, therefore, the elastic portions of the torque limiting members may conceivably be so aged with time that the pressing force cannot be kept constant. In this case, slip torque set in manufacturing cannot be maintained, whereby torque control cannot be precisely performed. When the torque limiter according to Japanese Patent Laying-Open No. 2005-344858 is applied to a take-up reel of an image generating apparatus comprising a driving source transporting an ink sheet of an ink sheet cartridge and the take-up reel transmitting the driving force of the driving source to a take-up bobbin of the ink sheet cartridge and taking up the ink sheet on the take-up bobbin, therefore, the take-up reel cannot perform proper torque control on the take-up bobbin upon action of the torque limiter function.

In the conventional torque limiter proposed in the aforementioned Japanese Patent Laying-Open No. 7-269589, the power output member and the power input member must be arranged inside the torsion coil spring, in order to utilize clamping force of the torsion coil spring reducing the coil diameter. Therefore, the power output member and the power input member are in contact with each other through the friction member on positions close to the rotation axes thereof, whereby the contact regions are reduced particularly in the circumferential direction. Thus, the torsion coil spring must apply limited clamping force to the small contact regions, whereby it is conceivably difficult for the torque limiter to stably operate. When the torque limiter according to Japanese Patent Laying-Open No. 7-269589 is applied to the take-up reel of the image generating apparatus comprising the driving source transporting the ink sheet of the ink sheet cartridge and the take-up reel transmitting the driving force of the driving source to the take-up bobbin of the ink sheet cartridge and taking up the ink sheet on the take-up bobbin, therefore, the ink sheet cannot be stably taken up on the take-up bobbin with proper tensile force.

In the conventional torque limiter proposed in the aforementioned Japanese Patent Laying-Open No. 5-106641, the large- and small-diametral coil portions of the coil spring in contact with the inner peripheral surface of the outer race and the outer peripheral surface of the inner race respectively themselves directly perform sliding operations (rotating operations) upon action of the torque limiter function. Therefore, the coil spring conceivably generates heat due to friction and stops this heat generation upon nonaction of the torque limiter function. Consequently, the elastic force of the coil spring is conceivably aged with time due to repetitive heat generation and cooling. In this case, slip torque set in manufacturing cannot be maintained, whereby torque control cannot be precisely performed. When the torque limiter according to Japanese Patent Laying-Open No. 5-106641 is applied to the take-up reel of the image generating apparatus comprising the driving source transporting the ink sheet of the ink sheet cartridge and the take-up reel transmitting the driving force of the driving source to the take-up bobbin of the ink sheet cartridge and taking up the ink sheet on the take-up bobbin, therefore, the take-up reel cannot perform proper torque control on the take-up bobbin upon action of the torque limiter function.

In the conventional bidirectional torque limiter proposed in the aforementioned Japanese Patent Laying-Open No. 7-229524, the clockwise and counterclockwise coil portions of the coil spring in contact with the inner peripheral surface of the outer tube and the spring storage portion of the inner tube respectively themselves perform sliding operations (rotating operations) upon action of the torque limiter function. Therefore, the coil spring conceivably generates heat due to friction and stops this heat generation upon nonaction of the torque limiter function. Consequently, the elastic force of the coil spring is conceivably aged with time due to repetitive heat generation and cooling. In this case, slip torque set in manufacturing cannot be maintained, whereby torque control cannot be precisely performed. When the bidirectional torque limiter described in Japanese Patent Laying-Open No. 7-229524 is applied to a take-up reel of an image generating apparatus comprising a driving source transporting an ink sheet of an ink sheet cartridge and the take-up reel transmitting the driving force of the driving source to a take-up bobbin of the ink sheet cartridge and taking up the ink sheet on the take-up bobbin, therefore, the take-up reel cannot perform proper torque control on the take-up bobbin upon action of the torque limiter function, similarly to the case of the torque limiter described in Japanese Patent Laying-Open No. 5-106641.

In the conventional ribbon take-up mechanism proposed in the aforementioned Japanese Patent Laying-Open No. 2005-199520, the shaft portion of the bobbin gear and the bobbin shaft must be arranged inside the close-coiled spring, in order to utilize clamping force of the close-coiled spring reducing the coil diameter. Therefore, the shaft portion of the bobbin gear and the bobbin shaft are in contact with each other on positions close to the rotation axes thereof, whereby the contact regions are reduced particularly in the circumferential direction. Thus, the close-coiled spring must apply limited clamping force to the small contact regions, whereby it is conceivably difficult for the ribbon take-up mechanism to stably operate. When the ribbon take-up mechanism according to Japanese Patent Laying-Open No. 2005-199520 is applied to a take-up reel of an image generating apparatus comprising a driving source transporting an ink sheet of an ink sheet cartridge and the take-up reel transmitting the driving force of the driving source to a take-up bobbin of the ink sheet cartridge and taking up the ink sheet on the take-up bobbin, therefore, the ink sheet cannot be stably taken up on the take-up bobbin with proper tensile force, similarly to the case of the torque limiter described in Japanese Patent Laying-Open No. 7-269589.

SUMMARY OF THE INVENTION

The present invention has been proposed in order to solve the aforementioned problems, and an object of the present invention is to provide an image generating apparatus capable of stably taking up an ink sheet on a take-up bobbin with proper tensile force by performing proper torque control on the take-up bobbin.

An image generating apparatus according to an aspect of the present invention comprises a driving source transporting an ink sheet of an ink sheet cartridge and a take-up reel transmitting the driving force of the driving source to a take-up bobbin of the ink sheet cartridge and taking up the ink sheet on the take-up bobbin, while the take-up reel includes a reel member, integrally provided with a plurality of fragment portions concentrically with the rotation axis thereof, engaging with the take-up bobbin, a driving-side gear member fitted with the outer peripheral surfaces of the fragment portions of the reel member and a spring member press-fitted with the inner peripheral surfaces of the fragment portions of the reel member thereby bringing the fragment portions into pressure contact with the driving-side gear member.

In the image generating apparatus according to the aspect of the present invention, as hereinabove described, the take-up reel includes the reel member integrally provided with the plurality of fragment portions, the driving-side gear member fitted with the outer peripheral surfaces of the fragment portions of the reel member and the spring member press-fitted with the inner peripheral surfaces of the fragment portions of the reel member for bringing the fragment portions into pressure contact with the driving-side gear member, whereby the fragment portions can regularly press the driving-side gear member with prescribed pressing force through the spring member provided independently of the fragment portions without aging in shape, dissimilarly to a case where the fragment portions are integrally provided with elastic portions easily aged in shape with time. Therefore, the take-up reel can properly perform torque control on the take-up bobbin while keeping slip torque set in manufacturing. Further, the take-up reel includes the reel member integrally provided with the plurality of fragment portions, the driving-side gear member fitted with the outer peripheral surfaces of the fragment portions of the reel member and the spring member press-fitted with the inner peripheral surfaces of the fragment portions of the reel member for bringing the fragment portions into pressure contact with the driving-side gear member, whereby the driving-side gear member performs a sliding operation (rotating operation) with respect to the reel member upon action of a torque limiter function so that the spring member is not involved in sliding friction (rotating operation) between the driving-side gear member and the reel member. In other words, the spring member causes neither heat generation nor cooling resulting from friction, whereby the elastic force thereof is not aged with time. Therefore, the take-up reel can further properly perform torque control on the take-up bobbin while keeping the slip torque set in manufacturing. In addition, the take-up reel includes the reel member integrally provided with the plurality of fragment portions concentrically with the rotation axis thereof, the driving-side gear member fitted with the outer peripheral surfaces of the fragment portions of the reel member and the spring member press-fitted with the inner peripheral surfaces of the fragment portions of the reel member for bringing the fragment portions into pressure contact with the driving-side gear member, whereby the spring member can apply elastic force to circumferentially wide contact regions between the fragment portions larger in diameter than the rotation axis of the reel member and the driving-side gear member larger in diameter than the fragment portions in a direction expanding (the diameter of) the spring member. Thus, the take-up reel can stably operate as a torque limiter, dissimilarly to a case where the spring member applies elastic force to small contact regions while reducing the diameter thereof. Therefore, the take-up reel can stably take up the ink sheet on the take-up bobbin with proper tensile force.

In the image generating apparatus according to the aforementioned aspect, the spring member is preferably an annular coil spring, and the spring member is preferably press-fitted with the inner peripheral surfaces of the fragment portions of the reel member in a state reduced in coil diameter from an unloaded condition. According to this structure, pressing force for outwardly spreading the fragment portions of the reel member can be easily obtained through restoring force (elastic energy) of the coil spring restored to the unloaded condition from the state press-fitted with the inner peripheral surfaces of the fragment portions of the reel member.

In the image generating apparatus according to the aforementioned aspect, the fragment portions of the reel member preferably integrally have stop portions provided on the outer peripheral surfaces of the forward ends of the fragment portions for inhibiting the driving-side gear member from displacement toward a first side. According to this structure, the stop portions of the reel member come into contact with the driving-side gear member when the driving-side gear member rotates with driving torque exceeding a prescribed level and slips on the outer peripheral surfaces of the fragment portions of the reel member, thereby easily inhibiting the driving-side gear member from dropping from the reel member toward the first side thereof.

In the image generating apparatus according to the aforementioned aspect, the reel member preferably integrally has a stop section provided between the plurality of fragment portions of the reel member for inhibiting the driving-side gear member from displacement toward a second side. According to this structure, the stop section of the reel member comes into contact with the driving-side gear member when the driving-side gear member rotates with driving torque exceeding a prescribed level and slips on the outer peripheral surfaces of the fragment portions of the reel member, thereby easily inhibiting the driving-side gear member from dropping from the reel member toward the second side thereof.

In the image generating apparatus according to the aforementioned aspect, the reel member preferably integrally has stop portions provided on the outer peripheral surfaces of the forward ends of the fragment portions of said reel member for inhibiting the driving-side gear member from displacement toward a first side and a stop section provided between the plurality of fragment portions of the reel member for inhibiting the driving-side gear member from displacement toward a second side, and the stop portions and the stop section are preferably so arranged as to vertically hold the driving-side gear member therebetween along the direction of the rotation axis of the driving-side gear member. According to this structure, the plurality of stop portions and the stop section can reliably rotatably hold the driving-side gear member on the outer peripheral surfaces of the fragment portions of the reel member.

In the aforementioned structure having the stop portions and the stop section so arranged as to vertically hold the driving-side gear member therebetween, the stop portions are preferably provided on the outer peripheral surfaces of the forward ends of the fragment portions to be adjacent to both sides of the stop section. According to this structure, the stop section and the pair of stop portions adjacent to both sides thereof can vertically hold the driving-side gear member on the reel member, thereby reliably rotatably holding the driving-side gear member on the reel member with no backlash.

In the image generating apparatus according to the aforementioned aspect, the reel member preferably integrally has a seat portion provided between the plurality of fragment portions of the reel member for holding the spring member. According to this structure, the seat portion inhibits the spring member from movement toward a second side, whereby the spring member can be reliably arranged on the inner peripheral surfaces of the fragment portions of the reel member.

In the image generating apparatus according to the aforementioned aspect, the reel member preferably integrally has a protrusion provided on the inner peripheral surfaces of the forward ends of the fragment portions of the reel member for inhibiting the spring member from displacement toward a first side. According to this structure, the protrusion of the reel member inhibits the spring member from movement toward the first side, whereby the spring member can be easily inhibited from dropping from the inner peripheral surfaces of the fragment portions of the reel member toward the first side.

In the image generating apparatus according to the aforementioned aspect, the reel member preferably integrally has a protrusion provided on the inner peripheral surfaces of the forward ends of the fragment portions of the reel member for inhibiting the spring member from displacement toward a first side and a seat portion for holding the spring member, and the protrusion and the seat portion are preferably so arranged as to vertically hold the spring member therebetween. According to this structure, a plurality of protrusions and the seat portion can reliably hold the spring member on the inner peripheral surfaces of the fragment portions of the reel member.

In the aforementioned structure having the protrusion and the seat portion so arranged as to vertically hold the spring member therebetween, the protrusion is preferably provided on the inner peripheral surfaces of the fragment portions to be adjacent to both sides of the seat portion. According to this structure, the seat portion and the pair of protrusions adjacent to both sides thereof can vertically hold the spring member on the inner peripheral surfaces of the fragment portions, thereby reliably rotatably holding the spring member on the inner peripheral surfaces of the fragment portions of the reel member with no backlash.

In the image generating apparatus according to the aforementioned aspect, the reel member preferably integrally has a protrusion provided on the inner peripheral surfaces of the forward ends of the fragment portions of the reel member for inhibiting the spring member from displacement toward a first side and a seat portion for holding the spring member, and the plurality of fragment portions of the reel member are preferably concentrically arranged in a prescribed angular range, and a stop section and the seat portion are preferably alternately arranged between the fragment portions. According to this structure, the reel member can be concentrically integrally provided with the fragment portions, the stop section and the seat portion having functions different from each other respectively, whereby the driving-side gear member and the spring member can be stably arranged on the reel member.

In the image generating apparatus according to the aforementioned aspect, the reel member preferably integrally has a take-up bobbin engaging portion engaging with the take-up bobbin, and the driving-side gear member preferably integrally has a driving-side gear portion. According to this structure, the driving-side gear portion can easily transmit the driving torque transmitted to the driving-side gear member from the take-up bobbin engaging portion of the reel member to the take-up bobbin of the ink sheet cartridge.

The image generating apparatus according to the aforementioned aspect preferably further comprises a chassis of sheet metal and a bracket member for fixing the driving source, the reel member preferably has a shaft portion provided with a support shaft on a first end and a connecting portion provided in the vicinity of a second end opposite to the first end for connecting the shaft portion and the fragment portions with each other, and the support shaft of the reel member is preferably rotatably inserted into a bearing of the bracket member provided concentrically with the rotation axis of the reel member while the connecting portion of the reel member is preferably rotatably inserted into a receiving hole of the chassis provided concentrically with the rotation axis of the reel member. According to this structure, the reel member is rotatably supported with respect to the bracket member and the chassis on the two portions of the support shaft and the connecting portion having the same rotation axis, whereby the reel member can rotate with no axial runout.

In the aforementioned structure further comprising the chassis and the bracket member, the bearing of the bracket member is preferably formed by burring to cylindrically protrude from the surface of the bracket member. According to this structure, the length of the bearing can be increased due to the burring, thereby more reliably rotatably supporting the reel member with respect to the bracket member.

In the aforementioned structure further comprising the chassis and the bracket member, the receiving hole of the chassis is preferably formed by burring to have an inner side surface cylindrically protruding from the surface of the chassis. According to this structure, the length of the inner side surface of the receiving hole can be increased due to the burring, thereby more reliably rotatably supporting the reel member with respect to the chassis.

In the aforementioned structure further comprising the chassis and the bracket member, the support shaft of the reel member preferably has a diameter smaller than the diameter of the shaft portion, and the reel member is preferably so formed that a first end surface portion connecting the support shaft and the shaft portion with each other comes into contact a portion of the side surface of the bracket member close to the bearing thereby controlling movement of the reel member toward a first side. According to this structure, the reel member rotates while the first end surface portion is in contact with the side surface of the bracket member, whereby the reel member can be inhibited from deviating in the direction of the rotation axis.

In the aforementioned structure further comprising the chassis and the bracket member, the connecting portion of the reel member preferably has a diameter smaller than the diameter of the fragment portions, and the reel member is preferably so formed that a second end surface portion connecting the connecting portion and the fragment portions with each other comes into contact with a portion of the side surface of the chassis close to the receiving hole thereby controlling movement of the reel member toward a second side. According to this structure, the reel member rotates while the second end surface portion is in contact with the side surface of the chassis, whereby the reel member can be inhibited from deviating in the direction of the rotation axis.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

An embodiment of the present invention is now described with reference to the drawings.

First, the structure of a sublimatic printer 100 according to the embodiment of the present invention is described with reference to FIGS. 1 to 5. According to this embodiment, the present invention is applied to the sublimatic printer 100 employed as an exemplary image generating apparatus.

Figure 1:
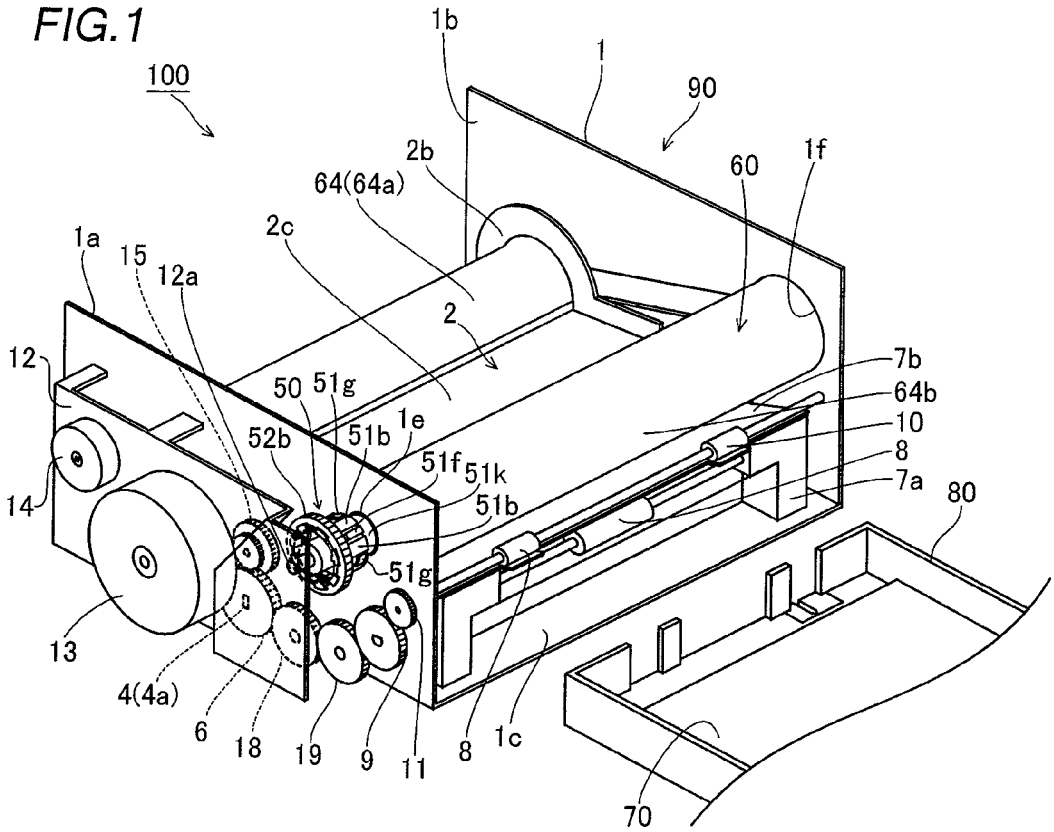
FIG. 1 is an exploded perspective view showing the overall structure of a sublimatic printer according to an embodiment of the present invention.
Figure 2:
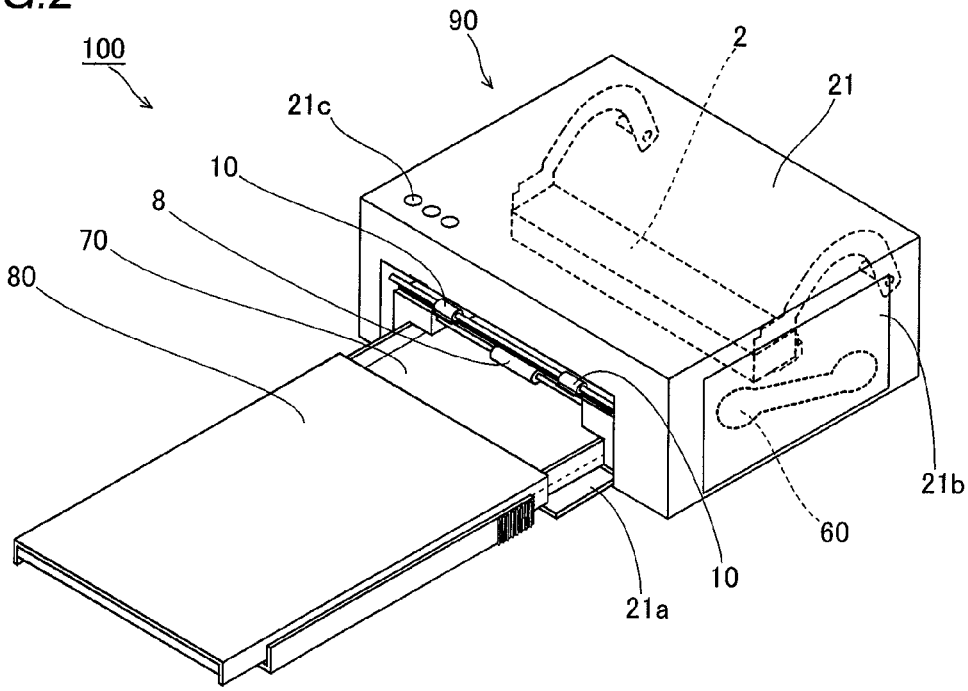
FIG. 2 is a perspective view showing the structure of the sublimatic printer according to the embodiment shown in FIG. 1.
Figure 3:
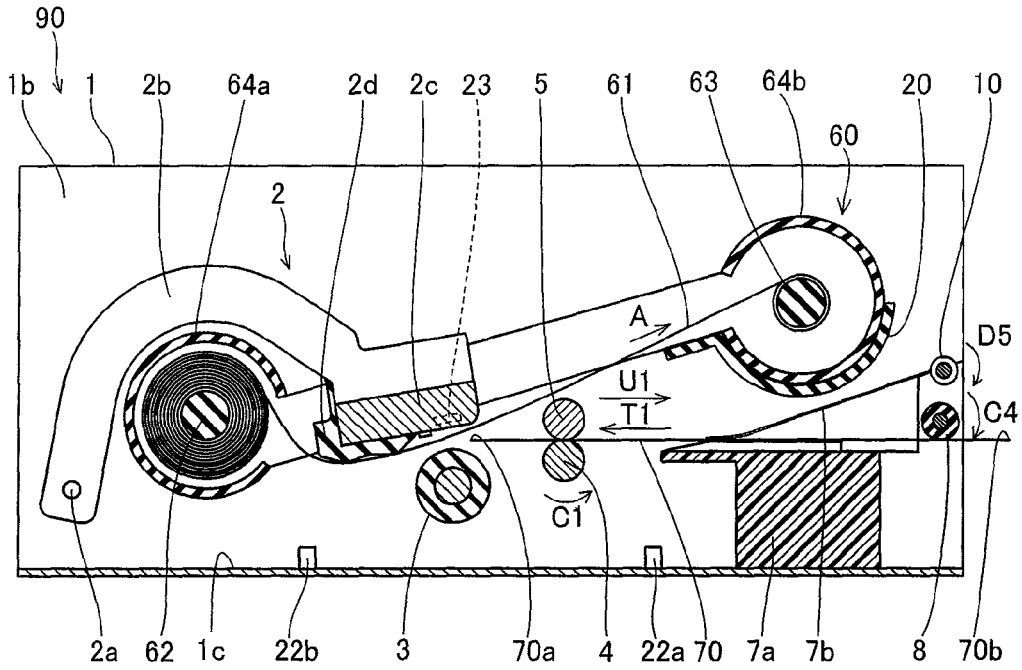
FIG. 3 is a sectional view showing the internal structure of the sublimatic printer according to the embodiment shown in FIG. 1.

As shown in FIG. 1, a printer body 90 of the sublimatic printer 100 according to the embodiment of the present invention comprises a chassis 1 of metal, a print head 2 for printing, a platen roller 3 (see FIG. 3) opposed to the print head 2, a feed roller 4 (see FIG. 3) of metal, a press roller 5 (see FIG. 3) of metal pressing the feed roller 4 with prescribed pressing force, a feed roller gear 6, a lower paper guide 7*a* of resin, an upper paper guide 7*b* of resin, a paper feed roller 8 of rubber, a paper feed roller gear 9, a paper discharge roller 10 of rubber, a paper discharge roller gear 11, a supply bobbin support portion 40 (see FIG. 5), a take-up reel 50 (see FIG. 5), a motor bracket 12 of sheet metal, a stepping motor 13 for transporting papers 70, another stepping motor 14 serving as a driving source for rotating the print head 2, a swingable swing gear 15, a plurality of intermediate gears 16 to 19 (see FIG. 4) and a cartridge support portion 20 (see FIG. 3) supporting an ink sheet cartridge 60 storing an ink sheet 61 (see FIG. 3). The printer body 90 is arranged in a housing 21 of resin, as shown in FIG. 2. The ink sheet cartridge 60 and a paper feed cassette 80 for storing the papers 70 supplied to the printer body 90 are detachably mounted on the printer body 90 of the sublimatic printer 100 according to this embodiment, as shown in FIG. 2. The stepping motor 13 is an example of the "driving source" in the present invention.

Figure 7:
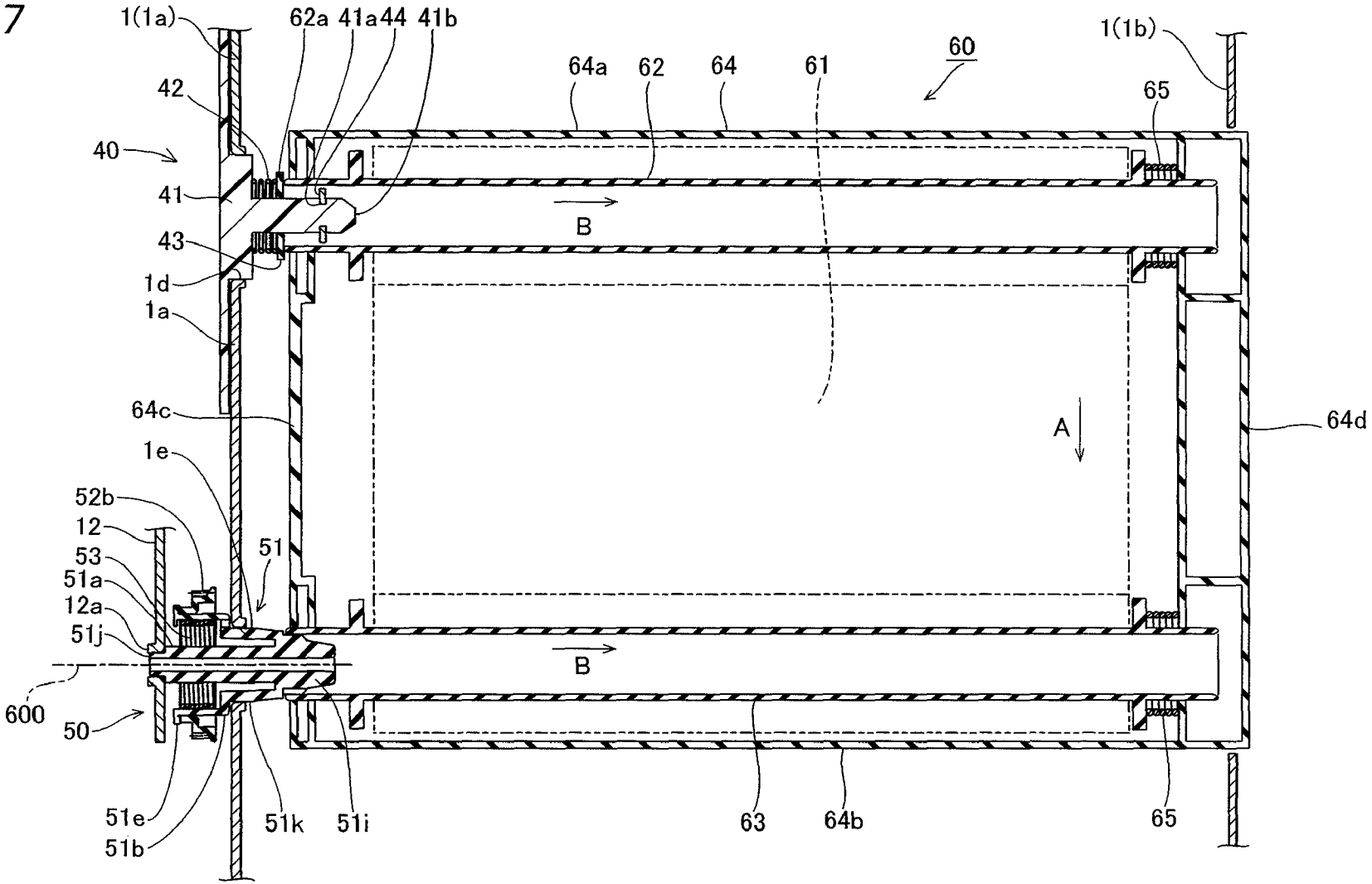
FIG. 7 is a sectional view of the ink sheet cartridge of the sublimatic printer according to the embodiment shown in FIG. 1 mounted on a printer body.

The chassis 1 has a first side surface 1*a* and a second side surface 1*b* opposed to each other and a bottom surface 1*c* coupling the first and second side surfaces 1*a* and 1*b* with each other, as shown in FIG. 1. A receiving hole 1*d* receiving the supply bobbin support portion 40 supporting a supply bobbin 62 of the ink sheet cartridge 60 described later and another receiving hole 1*e* rotatably receiving the take-up reel 50 supporting a take-up bobbin 63 of the ink sheet cartridge 60 are formed in the first side surface 1*a* of the chassis 1 by burring respectively, as shown in FIG. 7. The receiving holes 1*d* and 1*e* are so formed as to vertically cylindrically protrude toward the inner side of the chassis 1 from the first side surface 1*a*, as shown in FIG. 7. Further, the aforementioned motor bracket 12 of sheet metal is mounted on the first side surface 1*a* of the chassis 1 with a screw member (not shown), as shown in FIG. 1. On the other hand, a cartridge receiving hole if for receiving the ink sheet cartridge 60 is formed in the second side surface 1*b* of the chassis 1 opposed to the first side surface 1*a*, as shown in FIG. 1. Paper sensors 22*a* and 22*b* for detecting front and rear ends 70*a* and 70*b* of each paper 70 in printing are provided on the bottom surface 1*c* of the chassis 1, as shown in FIG. 3.

Figure 5:
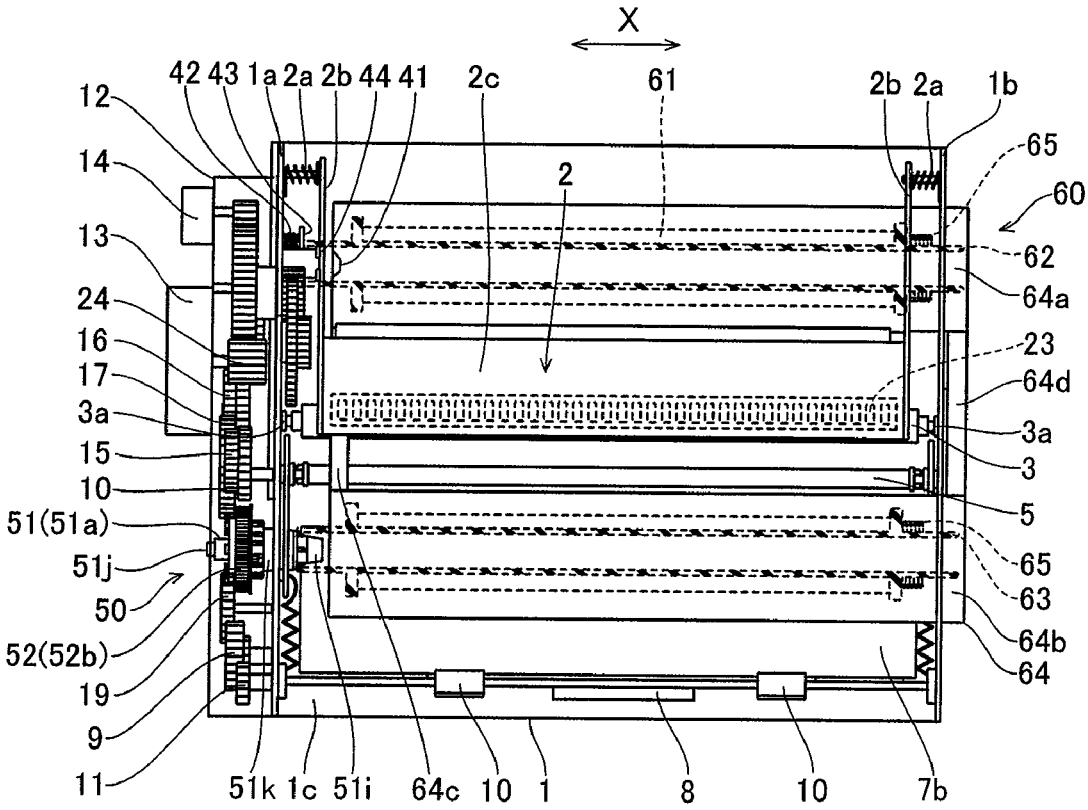
FIG. 5 is a plan view of the sublimatic printer according to the embodiment shown in FIG. 1.

The print head 2 includes a pair of support shafts 2*a*, a pair of arm portions 2*b*, a head portion 2*c* and a head cover 12*d* (see FIG. 3) of resin mounted on the head portion 2*c*, as shown in FIGS. 3 and 5. The print head 2 is mounted inside the first and second side surfaces 1*a* and 1*b* of the chassis 1 to be rotatable about the support shafts 2*a* respectively, as shown in FIG. 5. A plurality of heating elements 23 generating heat upon application of a voltage pulse are provided on the head portion 2*c* of the print head 2 in alignment with each other at a prescribed interval along the cross direction (along arrow X) of the papers 70 (see FIG. 1), as shown in FIG. 5. The heating elements 23 (see FIG. 5) are so formed that each heating element 23 forms one dot in printing.

Figure 4:
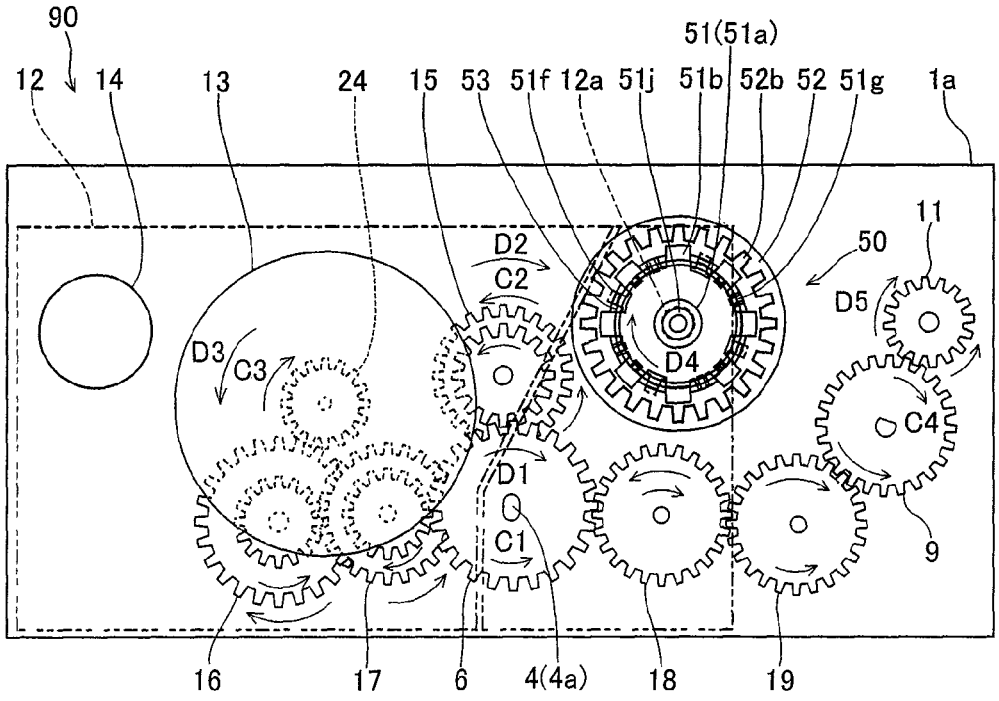
FIG. 4 is a side elevational view showing the arrangement of stepping motors and driving gears in the sublimatic printer according to the embodiment shown in FIG. 1.

A pair of platen roller bearings 3*a* are mounted on the first and second side surfaces 1*a* and 1*b* of the chassis 1 respectively for rotatably supporting the platen roller 3, as shown in FIG. 5. The feed roller 4 has a feed roller gear insertion portion 4*a* inserted into the feed roller gear 6, as shown in FIG. 4. The feed roller 4 (see FIG. 3) is rotatably supported by a feed roller bearing (not shown) mounted on the chassis 1. The press roller 5 (see FIG. 3) is also rotatably supported by a press roller bearing (not shown). The feed roller 4 and the press roller 5 rotate in a state holding each paper 70 therebetween, thereby transporting the paper 70 in a paper feed direction (along arrow T1) or a paper discharge direction (along arrow U1), as shown in FIG. 3.

The paper feed roller 8 is driven by the stepping motor 13, for rotating and supplying the papers 70 stored in the paper feed cassette 80 mounted on the sublimatic printer 100 one by one into the printer body 90, as shown in FIG. 1. The paper discharge roller 10 is driven by the stepping motor 13, for rotating and discharging printed papers 70 from the printer body 90.

As shown in FIGS. 4 and 5, a motor gear 24 of resin is mounted on the shaft portion of the stepping motor 13 mounted on the motor bracket 12. The motor bracket 12 and the stepping motor 13 are examples of the "bracket member" and the "driving source" in the present invention respectively. The stepping motor 13 functions as a driving source for driving a driving-side gear member 52 (more strictly, a gear portion 52*b*) of the take-up reel 50 described later, the paper feed roller gear 9, the paper discharge roller gear 11 and the feed roller gear 6 (see FIG. 4), as shown in FIGS. 4 and 5. The stepping motor 14 functions as a driving source for a pressing member (not shown) pressing the upper surface of the print head 2 and the like, as shown in FIG. 5. Thus, the stepping motor 14 is capable of rotating the print head 2 and pressing the print head 2 against the platen roller 3 from above, a shown in FIG. 5.

Figure 6:
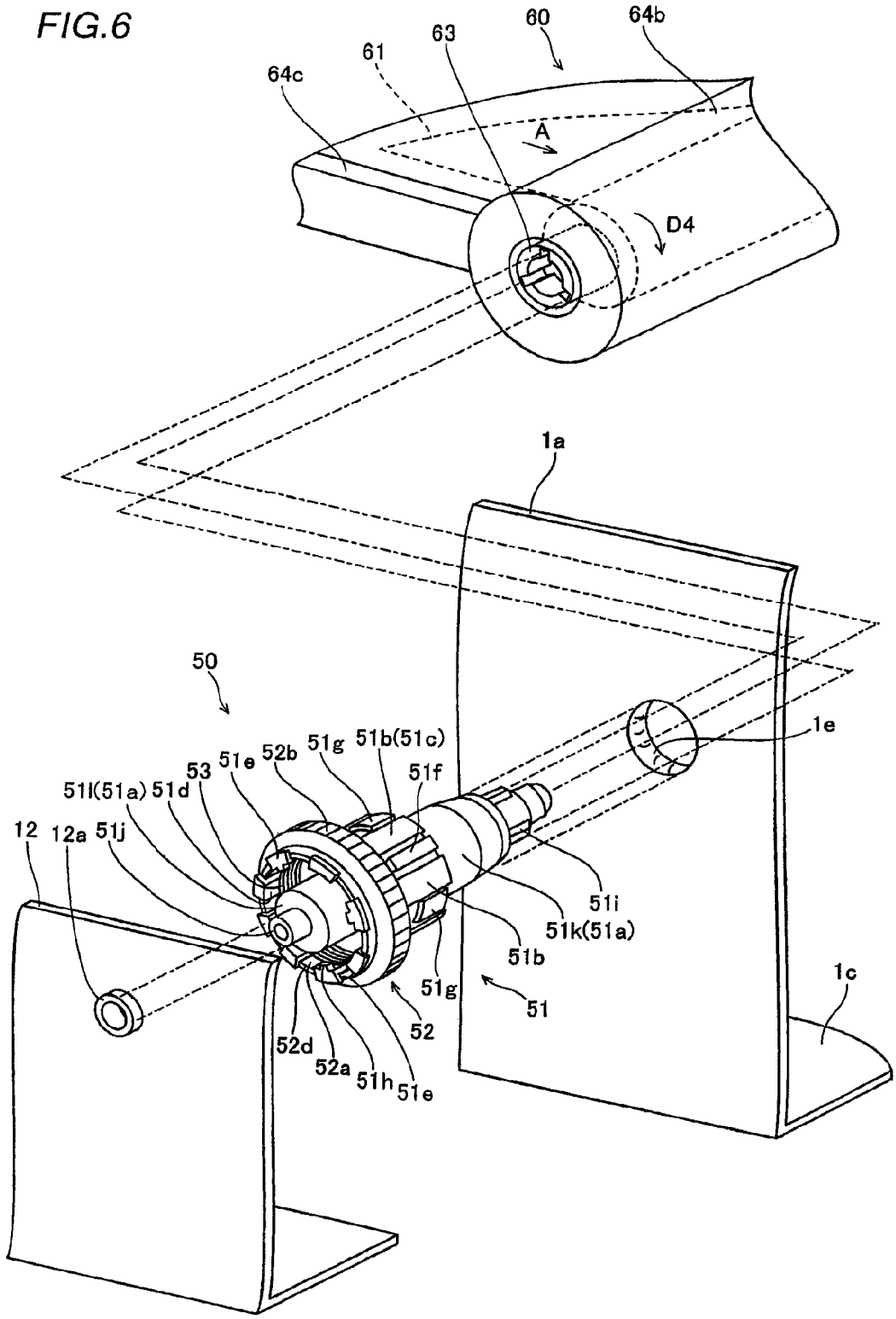
FIG. 6 is an exploded perspective view showing a take-up reel of the sublimatic printer according to the embodiment shown in FIG. 1 engaging with a take-up bobbin of an ink sheet cartridge.

The take-up reel 50 is capable of generating prescribed tensile force (transmission torque for the ink sheet 61) from the driving force of the stepping motor 13 (see FIG. 1) and taking up the ink sheet 61 wound on the take-up bobbin 63 by engaging with the take-up bobbin 63 rotatably arranged in a take-up bobbin storage portion 64*b* of the ink sheet cartridge 60 described later, as shown in FIGS. 6 and 7.

Figure 8:
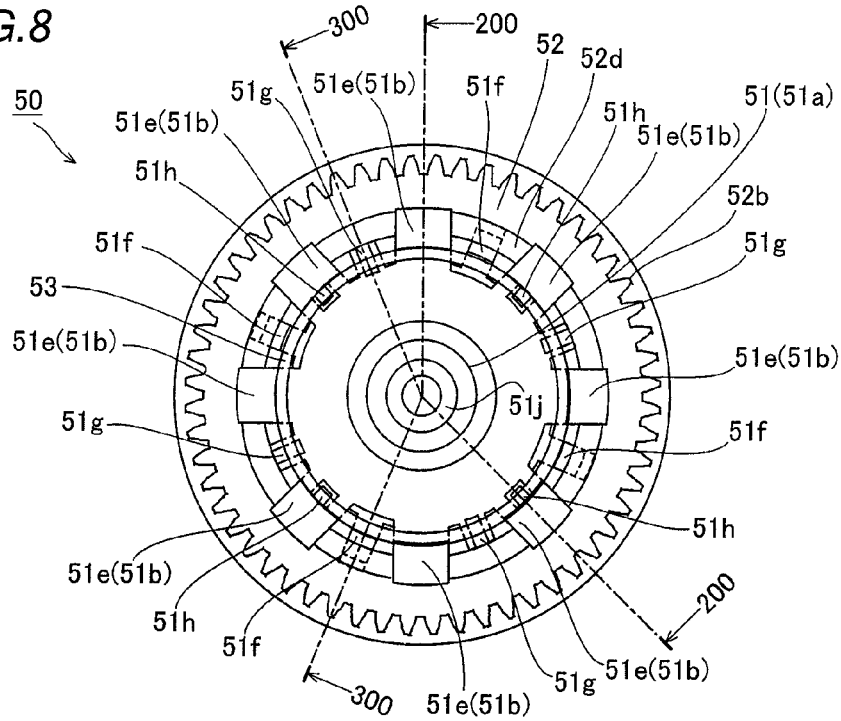
FIG. 8 is a plan view of the take-up reel according to the embodiment shown in FIG. 1.
Figure 9:
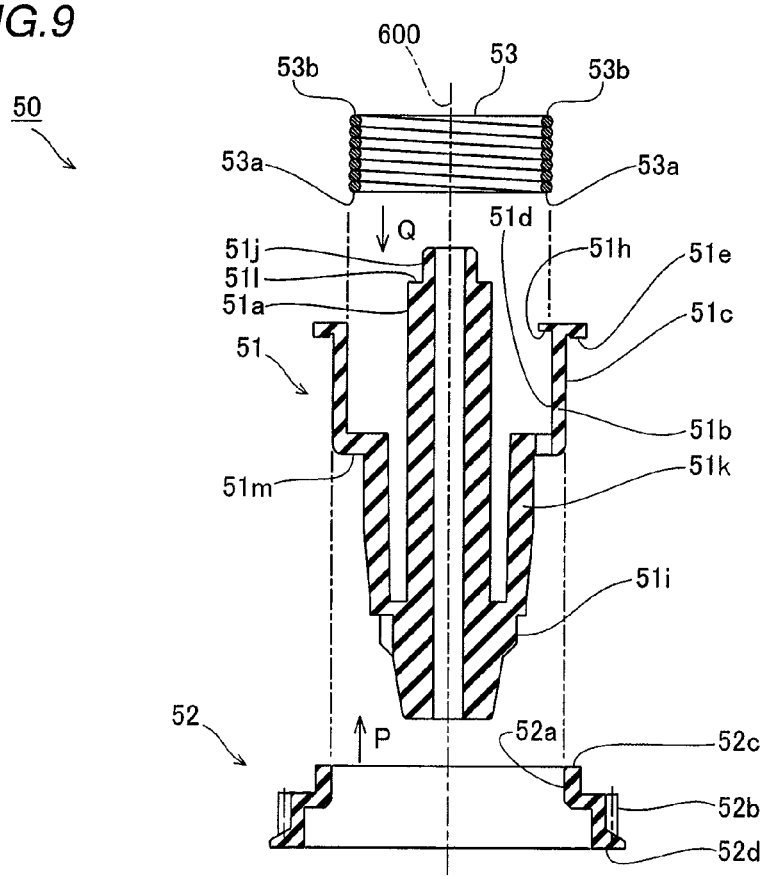
FIG. 9 is an exploded view of the take-up reel according to the embodiment shown in FIG. 1.

According to this embodiment, the take-up reel 50 is constituted of a reel member 51 of resin, the driving-side gear member 52 of resin and a coil spring 53 of metal, as shown in FIGS. 8 and 9. The coil spring 53 is an example of the "spring member" in the present invention.

Figure 10:
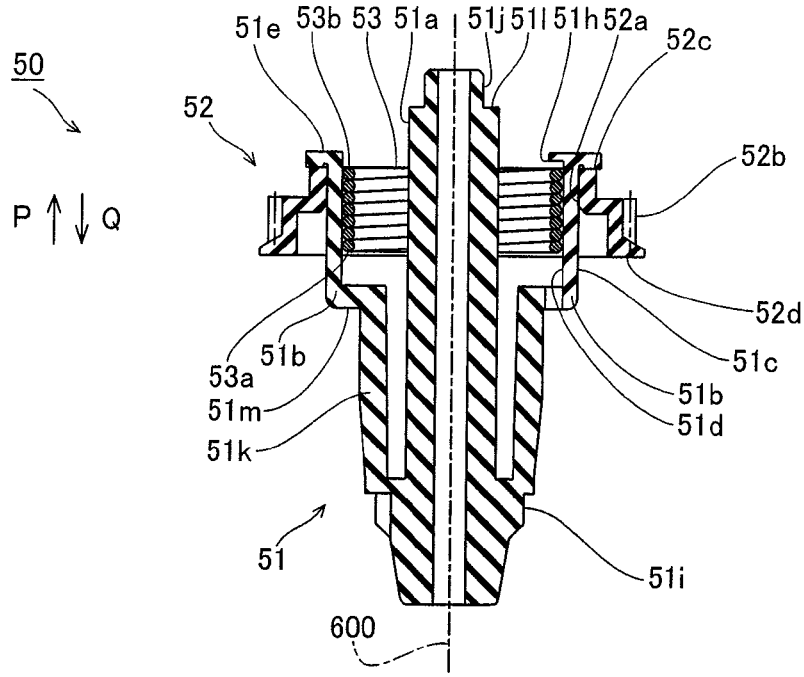
FIG. 10 is a sectional view taken along the line 200-200 in FIG. 8.

According to this embodiment, the reel member 51 has a plurality of (eight in this embodiment) fragment portions 51*b* integrally provided on the outer periphery of a shaft portion 51*a* concentrically with the shaft portion 51*a* to extend along the rotation axis 600 (shown by a one-dot chain line) of the take-up reel 51, as shown in FIG. 9. In other words, the eight fragment portions 51*b* are provided on the reel member 51 at an equiangular interval of 45° in the circumferential direction. When the driving-side gear member 52 is slid along arrow P (upward) from under the reel member 51, an inner peripheral surface 52*a* of the driving-side gear member 52 described later comes into contact with outer peripheral surfaces 51*c* of the fragment portions 51*b* of the reel member 51, whereby the driving-side gear member 52 can be fitted with the reel member 51. When the coil spring 53 is press-fitted into the reel member 51 from above along arrow Q (downward) while reducing the coil diameter as shown in FIG. 9, the outer side surface of the coil spring 53 comes into contact with inner peripheral surfaces 51*d* of the fragment portions 51*b* of the reel member 51 thereby radially spreading the fragment portions 51*b* of the reel member 51 outward and bringing the fragment portions 51*b* of the reel member 51 into pressure contact with the inner peripheral surface 52*a* of the driving-side gear member 52 previously fitted with the reel member 51, as shown in FIG. 10.

Figure 11:
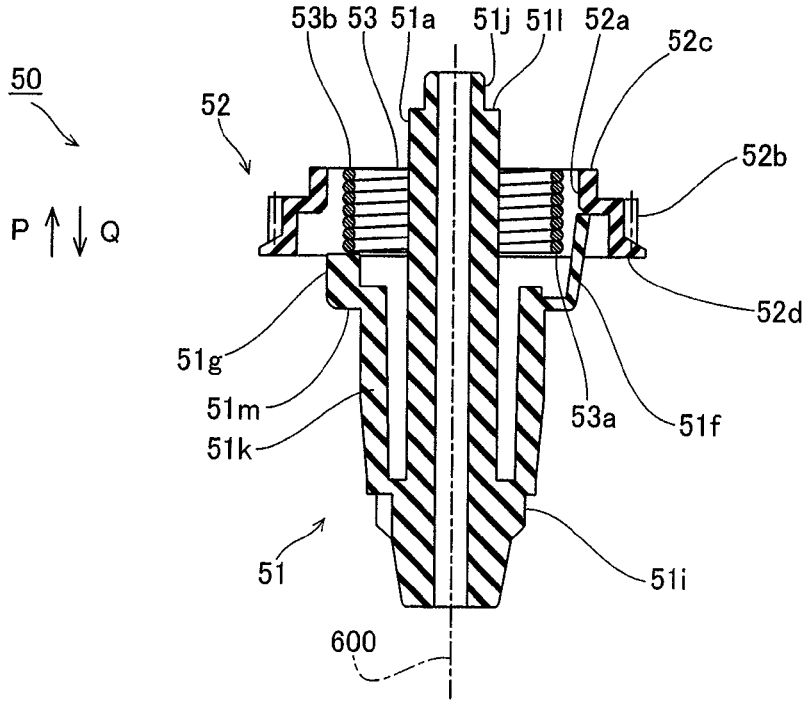
FIG. 11 is a sectional view taken along the line 300-300 in FIG. 8.
Figure 12:
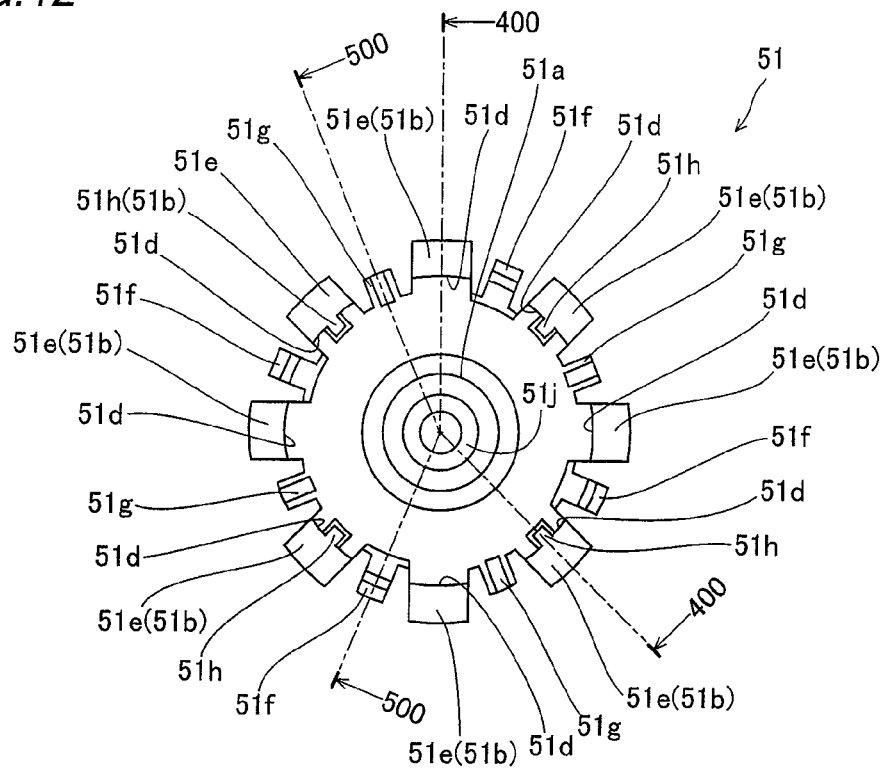
FIG. 12 is a plan view of a reel member of the take-up reel according to the embodiment shown in FIG. 1.
Figure 13:
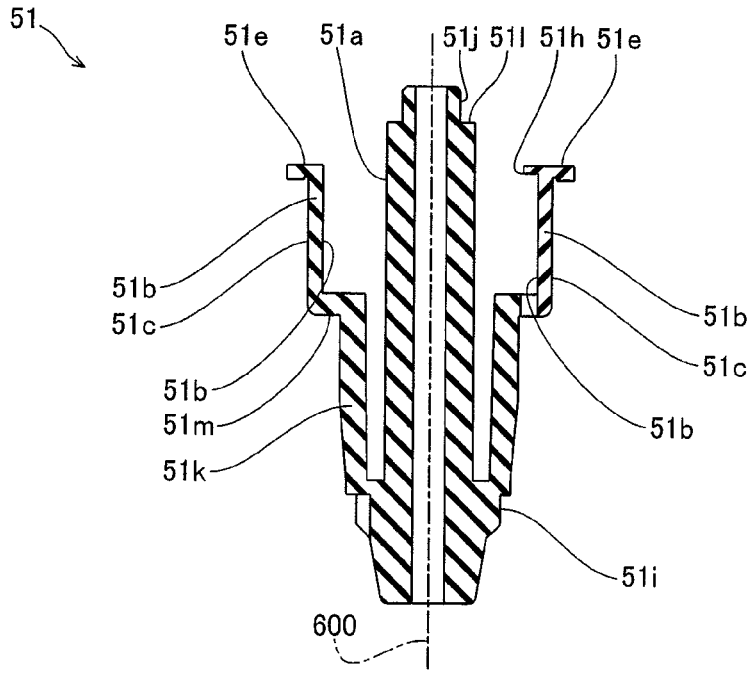
FIG. 13 is a sectional view taken along the line 400-400 in FIG. 12.
Figure 14:
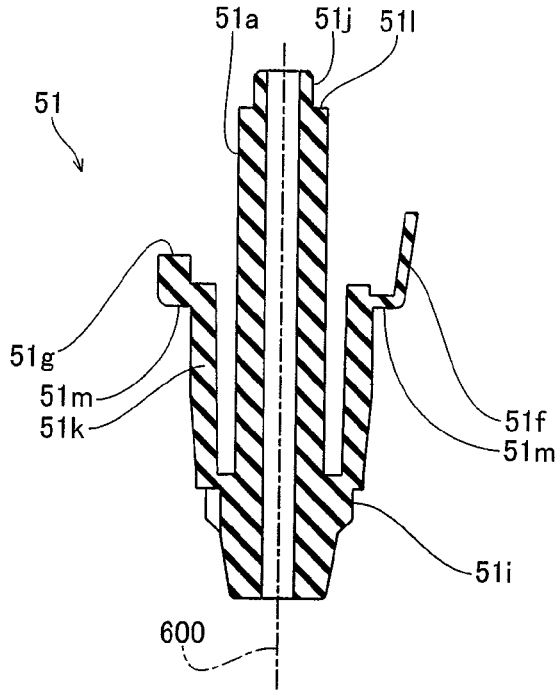
FIG. 14 is a sectional view taken along the line 500-500 in FIG. 12.

According to this embodiment, stop portions 51*e* horizontally extending from the forward ends of the fragment portions 51*b* of the reel member 51 toward the outer peripheral surfaces 51*c* of the fragment portions 51*b* are integrally formed on the fragment portions 51*b*, as shown in FIGS. 12 and 13. When the driving-side gear member 52 is fitted with the reel member 51, the stop portions 51*e* come into contact with a first side surface 52*c* of the driving-side gear member 52 thereby inhibiting the driving-side gear member 52 from displacement along arrow P (upward), as shown in FIG. 10. Further, a plurality of (four in this embodiment) stop sections 51*f* slightly obliquely extending outward upwardly from the axial direction of the rotation axis 600 (shown by a one-dot chain line in FIG. 14) are integrally provided on the reel member 51 between adjacent ones of the fragment portions 51*b* (see FIG. 12) of the reel member 51, as shown in FIGS. 12 and 14. In other words, the four stop sections 51*f* are concentrically provided at an equiangular interval of 90°. When the driving-side gear member 52 is fitted with the reel member 51, the stop sections 51*f* come into contact with second side surface 52*d* of the driving-side gear member 52 thereby inhibiting the driving-side gear member 52 from displacement along arrow Q (downward), as shown in FIG. 11. The stop portions 51*e* (see FIG. 10) and the stop sections 51*f* of the reel member 51 position the driving-side gear member 52 fitted with the outer peripheral surfaces 51*c* of the fragment portions 51*b* of the reel member 51 in the axial direction (along arrows P and Q), as shown in FIGS. 10 and 11.

According to this embodiment, a plurality of (four in this embodiment) seat portions 51*g* extending along the rotation axis 600 (shown by the one-dot chain line in FIG. 14) are integrally provided on the reel member 51 between adjacent ones of the fragment portions 51*b* (see FIG. 12) of the reel member 51, as shown in FIGS. 12 and 14. In other words, the four seat portions 51*g* are concentrically provided at an equiangular interval of 90°. When the coil spring 53 is press-fitted into the reel member 51, the seat portions 51*g* come into contact with a first side surface 53*a* of the coil spring 53 thereby holding the coil spring 53 and inhibiting the same from movement along arrow Q (downward), as shown in FIG. 11. Further, protrusions 51*h* are integrally provided on the fragment portions 51*b* of the reel member 51 to protrude toward the inner peripheral surfaces 51*d* of the forward ends of the fragment portions 51*b*, as shown in FIG. 13. When the coil spring 53 is press-fitted into the reel member 51, the protrusions 51*h* come into contact with a second side surface 53*b* of the coil spring 53, thereby inhibiting the coil spring 53 from displacement along arrow P (upward), as shown in FIG. 10. The seat portions 51*g* (see FIG. 11) and the protrusions 51*h* (see FIG. 10) of the reel member 51 reliably keep the coil spring 53 in the state press-fitted with the inner peripheral surfaces 51*d* of the fragment portions 51*b* of the reel member 51, as shown in FIG. 12. The stop sections 51*f* and the seat portions 51*g* of the reel member 51 are alternately arranged between the adjacent fragment portions 51*b*, as shown in FIG. 12.

According to this embodiment, a take-up bobbin engaging portion 51*i* engaging with the take-up bobbin 63 of the ink sheet cartridge 60 is integrally provided on the forward end of the shaft portion 51*a* of the reel member 51, as shown in FIG. 6. Further, a support shaft 51*j* inserted into a bearing 12*a* of the motor bracket 12 described later is integrally provided on an end of the shaft portion 51*a* of the reel member 51 opposite to the take-up bobbin engaging portion 51*i*, as shown in FIG. 6. Therefore, a connecting portion 51*k* and the support shaft 51*j* of the shaft portion 51*a* of the reel member 51 are rotatably supported in the receiving hole 1*e* provided on the first side surface 1*a* of the chassis 1 and the bearing 12*a* of the motor bracket 12 respectively as shown in FIG. 7, whereby the take-up reel 50 can rotate the take-up bobbin 63 in a direction for taking up the ink sheet 61 with no axial runout.

At this time, an end surface 51*m* (see FIG. 10) connecting the connecting portion 51*k* and the fragment portions 51*b* with each other comes into contact with a portion of the first side surface 1*a* of the chassis 1 close to the receiving hole 1*e* thereby controlling movement of the take-up reel 50 along arrow B (see FIG. 7), while another end surface 51*l* (see FIG. 6) connecting the support shaft 51*j* and the shaft portion 51*a* with each other comes into contact with a portion of the side surface of the motor bracket 12 close to the bearing 12*a* thereby controlling movement of the take-up reel 50 in the opposite direction (see FIG. 7). The end surfaces 51*l* and 51*m* are examples of the "first end surface portion" and the "second end surface portion" in the present invention respectively.

Figure 15:
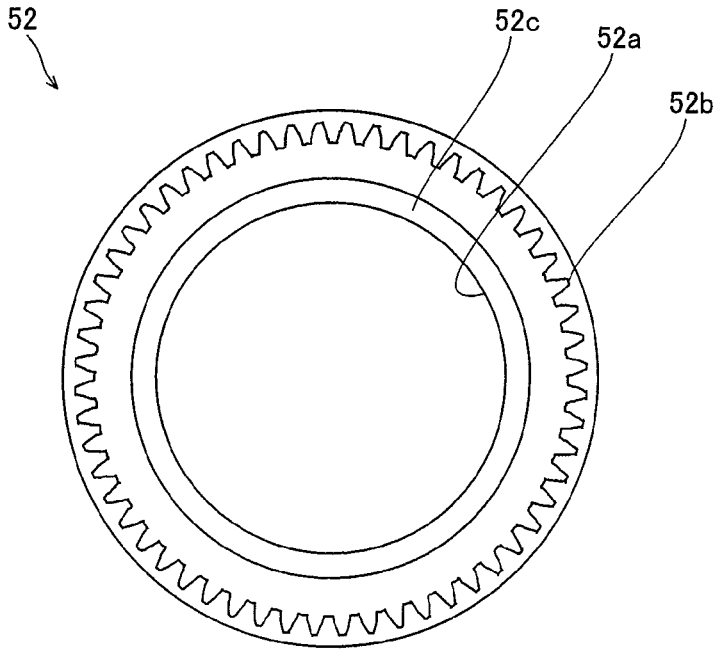
FIG. 15 is a plan view of a driving-side gear of the take-up reel according to the embodiment shown in FIG. 1.

According to this embodiment, the driving-side gear member 52 of resin has a hollow shape, and is integrally provided with the inner peripheral surface 52*a* coming into contact with the outer peripheral surfaces 51*c* of the fragment portions 51*b* of the reel member 51, the gear portion 52*b* generating driving torque on the outer peripheral side and the first and second side surfaces 52*c* and 52*d*, as shown in FIG. 15. The gear portion 52*b* is an example of the "driving-side gear portion" in the present invention. The take-up reel 50 is arranged on a position meshable with the gear portion 52*b* of the driving-side gear member 52 upon swinging of the swing gear 15, as shown in FIG. 5.

According to this embodiment, the eight fragment portions 51*b* of the reel member 51 are in pressure contact with the driving-side gear member 52 of the take-up reel 50 with pressing force previously set by the coil spring 53, as shown in FIG. 10. When the driving-side gear member 52 generates driving torque exceeding frictional force between the inner peripheral surface 52*a* of the driving-side gear member 52 and the outer peripheral surfaces 51*c* of the fragment portions 51*b* of the reel member 51 resulting from the pressing force of the coil spring 53, therefore, the inner peripheral surface 52*a* of the driving-side gear member 52 and the outer peripheral surfaces 51*c* of the fragment portions 51*b* of the reel member 51 so slip that the driving torque of the driving-side gear member 52 is not entirely transmitted to the reel member 51. When the driving-side gear member 52 rotates with driving torque below the frictional force between the inner peripheral surface 52*a* of the driving-side gear member 52 and the outer peripheral surfaces 51*c* of the fragment portions 51*b* of the reel member 51 resulting from the pressing force of the coil spring 53, on the other hand, the inner peripheral surface 52*a* of the driving-side gear member 52 and the outer peripheral surfaces 51*c* of the fragment portions 51*b* of the reel member 51 remain unslipping so that the rotation of the driving-side gear member 52 is directly transmitted to the reel member 51.

The supply bobbin support portion 40 is so formed that a support member 41 of resin is inserted into a helical compression spring 42 and a press plate member 43 of metal while a stop member (C-ring) 44 is fitted into a groove 41*a* of the support member 41 so that the press plate member 43 is pressed by the helical coil spring 42 and comes into contact with the stop member 44, as shown in FIG. 7. Further, the supply bobbin support portion 40 is inserted into the receiving hole 1*d* provided in the first side surface 1*a* of the chassis 1 from outside so that the support member 41 is fixed to the first side surface 1*a* of the chassis 1, as shown in FIG. 7. Thus, the supply bobbin support portion 40 is so formed that the forward end 41*b* of the support member 41 is fitted into the supply bobbin 62 and the press plate member 43 comes into contact with an end surface 62*a* of the supply bobbin 62 with the prescribed pressing force when the ink sheet cartridge 60 is mounted on the printer body 90.

The bearing 12*a* is integrally provided on the motor bracket 12 by burring, as shown in FIGS. 6 and 7. The bearing 12*a* is so formed as to cylindrically protrude vertically outwardly from the surface of the motor bracket 12.

The lower paper guide 7*a* is set in the vicinity of the feed roller 4 and the press roller 5, as shown in FIG. 3. The upper paper guide 7*b* is mounted on the upper portion of the lower paper guide 7*a*. The upper paper guide 7*b* is capable of guiding the papers 70 to a paper feed path toward a printing portion through the lower surface thereof in paper feeding and guiding the papers 70 to a paper discharge path through the upper surface thereof in paper discharge, as shown in FIG. 3.

The housing 21 includes lid members 21*a* and 21*b* and pushbutton switches 21*c*, as shown in FIG. 2. The lid members 21*a* and 21*b* are rotatable about the lower ends thereof outward from the housing 21, as shown in FIG. 2. The lid member 21*a* of the housing 21 is openable/closable for mounting the paper feed cassette 80 on the printer body 90, as shown in FIG. 2. When the paper feed cassette 80 is dismounted from the printer body 90, the lid member 21*a* is so closed as to inhibit dust etc. from entering the printer body 90. The other lid member 21*b* of the housing 21 is openable/closable for mounting the ink sheet cartridge 60 on the printer body 90, as shown in FIG. 2. When the ink sheet cartridge 60 is neither mounted on nor dismounted from the printer body 90, the lid member 21*b* is so closed as to inhibit dust etc. from entering the printer body 90. The pushbutton switches 21*c* of the housing 21 are pressed by the user for starting printing, as shown in FIG. 2.

The ink sheet cartridge 60 includes the supply bobbin 62 for supplying the ink sheet 61 and the take-up bobbin 63 for taking up the supplied ink sheet 61 along arrow A, as shown in FIG. 7. A cartridge case 64 of resin constituting the ink sheet cartridge 60 is constituted of a supply bobbin storage portion 64*a* rotatably storing the supply bobbin 62, a take-up bobbin storage portion 64*b* rotatably storing the take-up bobbin 63 and a pair of coupling portions 64*c* and 64*d* coupling the supply bobbin storage portion 64*a* and the take-up bobbin storage portion 64*b* with each other at a prescribed distance, as shown in FIG. 7. When the supply bobbin storage portion 64*a* and the take-up bobbin storage portion 64*b* store the supply bobbin 62 and the take-up bobbin 63 respectively, therefore, the ink sheet 61 wound on the supply bobbin 62 and the take-up bobbin 63 is exposed on the space of the prescribed distance between the supply bobbin storage portion 64*a* and the take-up bobbin storage portion 64*b*, as shown in FIGS. 3 and 5. The ink sheet 61 is formed by successively linking ink sheets of three colors, i.e., Y (yellow), M (magenta) and C (cyan) with each other. The front and rear ends of the ink sheet 61 (see FIG. 7) are fixed to the bobbin shafts of the take-up bobbin 63 (see FIG. 7) and the supply bobbin 62 (see FIG. 7) respectively. Even when the ink sheet 61 (see FIG. 7) is completely taken up on the take-up bobbin 63 (see FIG. 7), therefore, the rear end thereof is still linked with the supply bobbin 62 (see FIG. 7). Helical compression springs 65 are provided in the supply bobbin storage portion 64*a* and the take-up bobbin storage portion 64*b* of the ink sheet cartridge 60 respectively, as shown in FIG. 7. The helical coil springs 65 regularly urge the ink sheet cartridge 60 mounted on the printed body 90 in a direction (along arrow B) for taking out the ink sheet cartridge 60, as shown in FIG. 7.

A printing operation of the sublimatic printer 100 according to this embodiment is now described with reference to FIGS. 1 to 4, 6, 7, 10, 16 and 17.

Figure 16:
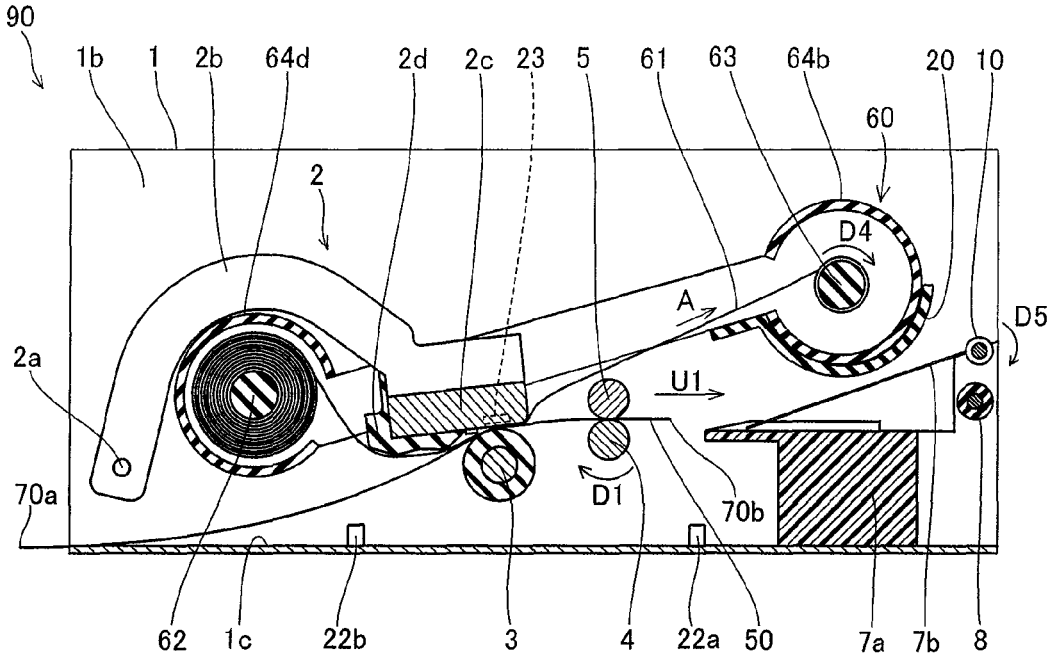
FIGS. 16 and 17 are diagrams for illustrating a printing operation of the sublimatic printer according to the embodiment shown in FIG. 1.

When the user presses any of the pushbutton switches 21 (see FIG. 2) to start the printing operation, the stepping motor 13 (see FIG. 1) transports (feeds) each paper 70 stored in the paper feed cassette 80 (see FIG. 2) toward a printing start position, as shown in FIG. 3. More specifically, the stepping motor 13 is so driven that the motor gear 24 mounted thereon rotates along arrow C3 and the feed roller gear 6 rotates along arrow C1 through the intermediate gears 16 and 17, as shown in FIG. 4. Thus, the paper feed roller 8 rotates along arrow C4 following the rotation of the paper feed roller gear 9 (see FIG. 4) as shown in FIG. 3, thereby transporting the paper 70 in contact with the lower surface thereof in the paper feed direction (along arrow T1). At this time, the paper sensor 22*a* detects the front end 70*a* of the paper 70 as shown in FIG. 3, thereby recognizing correct feeding of the paper 70. Following the transportation of the paper 70 in the paper feed direction (along arrow T1), the paper sensor 22*b* (see FIG. 3) also detects the front end 70*a* (see FIG. 3) of the paper 70. Thereafter the lower paper guide 7*a* (see FIG. 3) guides the paper 70 further transported by the paper feed roller 8 (see FIG. 3) above the paper sensor 22*b* (see FIG. 3) to travel along the paper feed direction (along arrow T1), so that the feed roller 4 (see FIG. 3) and the press roller 5 (see FIG. 3) transport the same to the printing start position shown in FIG. 16. When the paper 70 is transported to the printing start position, the paper sensor 22*a* detects the rear end 70*b* of the paper 70 in the paper feed direction, as shown in FIG. 16. At this time, the swingable swing gear 15 (see FIG. 4) is not in mesh with the gear portion 52*b* (see FIG. 4) of the take-up reel 50, whereby the gear portion 52*b* (see FIG. 4) of the take-up reel 50 (see FIG. 4) remains unrotating. In paper feeding, therefore, the ink sheet 61 wound on the take-up bobbin 63 and the supply bobbin 62 is neither transported in the take-up direction (along arrow A) nor taken up on the take-up bobbin 63, as shown in FIG. 3.

Thereafter the stepping motor 14 (see FIG. 4) is so driven as to lower the print head 2 to a printing position with pressing means (not shown), as shown in FIG. 16. Then, the paper 70 is transported in the paper discharge direction (along arrow U1) while the print head 2 and the platen roller 3 press the paper 70 and the ink sheet 61 and the heating elements 23 provided on the head portion 2*c* of the print head 2 generate heat, as shown in FIG. 16. The heating elements 23 so generate heat as to melt/sublimate the ink of the ink sheet 61 and transfer the same to the paper 70, thereby performing printing (printing operation).

In this operation, the stepping motor 13 is so driven that the motor gear 24 mounted thereon rotates along arrow D3 and the feed roller gear 6 rotates along arrow D1 through the intermediate gears 16 and 17, a shown in FIG. 4. Thus, the feed roller 4 rotates along arrow D1 in FIG. 16. Further, the paper discharge roller gear 11 (see FIG. 4) and the paper discharge roller 10 (see FIG. 16) rotate along arrow D5 (see FIG. 16) through the intermediate gears 18 and 19 (see FIG. 4) and the paper feed roller gear 9 (see FIG. 4). Thus, the paper 70 is transported in the paper discharge direction (along arrow U1 in FIG. 16) corresponding to a printing direction. At this time, the swingable swing gear 15 (see FIG. 4) swings in a direction (along arrow D2 in FIG. 4) for meshing with the gear portion 52*b* (see FIG. 4) of the driving-side gear member 52 (see FIG. 4) of the take-up reel 50 (see FIG. 4). Then, the swing gear 15 (see FIG. 4) meshes with the gear portion 52*b* (see FIG. 4) of the take-up reel 50 (see FIG. 4), whereby the driving-side gear member 52 (see FIG. 4) rotates along arrow D4 (see FIG. 4). Thus, the take-up bobbin 63 engaging with the take-up reel 50 (see FIG. 6) rotates along arrow D4 (see FIG. 4) as shown in FIG. 16, thereby transporting the ink sheet 61 along arrow A from the supply bobbin 62 through the printing portion held between the print head 2 and the platen roller 3 and taking up the same thereon with prescribed tensile force.

According to this embodiment, the coil spring 53 presses the reel member 51 of the take-up reel 50 against the inner peripheral surface 52*a* of the driving-side gear member 52 with the previously set pressing force, as shown in FIG. 10. When the driving-side gear member 52 generates driving torque exceeding frictional force between the inner peripheral surface 52*a* of the driving-side gear member 52 and the outer peripheral surfaces 51*c* of the fragment portions 51*b* of the reel member 51 resulting from the pressing force of the coil spring 53, therefore, the inner peripheral surface 52*a* of the driving-side gear member 52 and the outer peripheral surfaces 51*c* of the fragment portions 51*b* of the reel member 51 so slip that the driving torque of the driving-side gear member 52 is not entirely transmitted to the reel member 51. In other words, the reel member 51 (see FIG. 4) rotates at a rotational frequency below that of the driving-side gear member 52 (see FIG. 4) although the stepping motor 13 (see FIG. 4) drives the driving-side gear member 52 (see FIG. 4) to rotate along arrow D4 (see FIG. 4) at a prescribed rotational frequency. Thus, the transported ink sheet 61 (see FIG. 16) is taken up on the take-up bobbin 63 regularly with constant tensile force.

Thus, the paper 70 is transported along arrow U1 in FIG. 16 and the ink sheet 61 is taken up on the take-up bobbin 63 for continuously transferring the ink from the ink sheet 61 (Y ink sheet) to the paper 70 in the printing operation. Then, the printed paper 70 is further transported along arrow U1 in FIG. 16 similarly to the aforementioned transport operation of the paper 70 in printing, to be discharged from the printer body 90.

Figure 17:
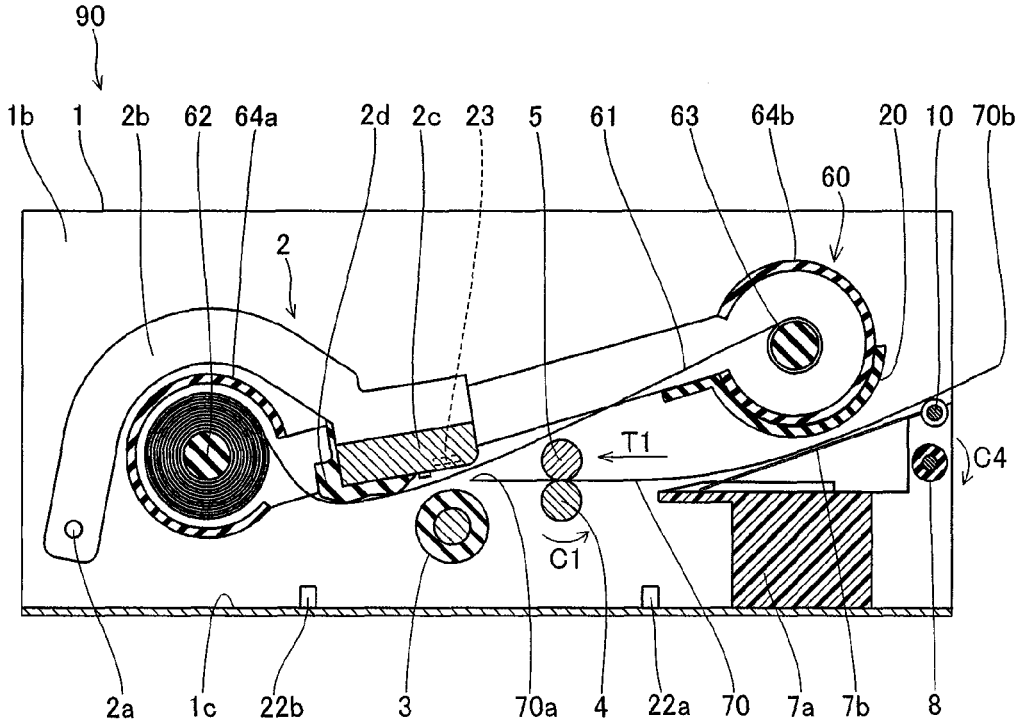

Upon termination of the printing with the Y (yellow) ink sheet, the stepping motor 14 (see FIG. 1) is so driven as to move the head portion 2*c* of the print head 2 to a position separated from the platen roller 3 with pressing means (not shown), as shown in FIG. 17.

Then, the stepping motor 13 is so driven that the motor gear 24 mounted thereon rotates along arrow C3 and the feed roller gear 6 rotates along arrow C1 through the intermediate gears 16 and 17, as shown in FIG. 4. Thus, the feed roller 4 rotates along arrow C1 following the rotation of the feed roller gear 6 (see FIG. 4) as shown in FIG. 17, thereby transporting the paper 70 in the paper feed direction (along arrow T1) again so that the paper sensors 22*a* and 22*b* detect the paper 70. At this time, the swingable swing gear 15 (see FIG. 4) swings in a direction (along arrow C2 in FIG. 4) for separating from the gear portion 52*b* (see FIG. 4) of the driving-side gear member 52 (see FIG. 4) of the take-up reel 50 (see FIG. 4). Thus, the swing gear 15 (see FIG. 4) and the gear portion 52*b* (see FIG. 4) of the driving-side gear member 52 (see FIG. 4) are released from meshing, so that the ink sheet 61 wound on the supply bobbin 62 is not taken up on the take-up bobbin 63 by the take-up reel 50 but only the paper 70 is transported in the paper feed direction (along arrow T1 in FIG. 3).

Thereafter operations similar to the aforementioned operation for printing with the Y (yellow) ink sheet shown in FIGS. 3, 16 and 17 are repeated as to the M (magenta) and C (cyan) ink sheets.

When the M and C ink sheets forming the ink sheet 61 are transported along arrow A so that the inks thereof are thermally transferred to the paper 70, the take-up bobbin 63 of the take-up reel 50 (see FIG. 7) also takes up the ink sheet 61 as shown in FIG. 16, similarly to the operation of thermally transferring the ink from the Y ink sheet to the paper 70.

According to this embodiment, the inner peripheral surface 52*a* of the driving-side gear member 52 and the outer peripheral surfaces 51*c* of the fragment portions 51*b* of the reel member 51 so slip that the driving torque of the driving-side gear member 52 is not entirely transmitted to the reel member 51 when the driving-side gear member 52 generates driving torque exceeding the frictional force between the inner peripheral surface 52*a* of the driving-side gear member 52 and the outer peripheral surfaces 51*c* of the fragment portions 51*b* of the reel member 51 resulting from the pressing force of the coil spring 53, similarly to the operation of thermally transferring the ink from the Y ink sheet to the paper 70. In other words, the reel member 51 (see FIG. 4) rotates at a rotational frequency below that of the driving-side gear member 52 (see FIG. 4) although the stepping motor 13 (see FIG. 4) drives the driving-side gear member 52 (see FIG. 4) to rotate along arrow D4 (see FIG. 4) at the prescribed rotational frequency. Thus, the transported ink sheet 61 (see FIG. 16) is taken up on the take-up bobbin 63 regularly with the constant tensile force.

When completely printed with all inks of the ink sheet 61, the paper 70 is transported in the paper discharge direction (along arrow U1 in FIG. 17) and discharged from the printer body 90. The head portion 2*c* of the print head 2 rotates to a position upwardly separating from the platen roller 3 through the state shown in FIG. 3, thereby completing the printing operation on the paper 70.

According to this embodiment, the take-up reel 50 (see FIG. 7) inhibits the take-up bobbin 63 (see FIG. 7) from forced rotation in the take-up direction (along arrow D2 in FIG. 6) due to a torque limiter function when the ink sheet 61 (see FIG. 7) is entirely taken up on the take-up bobbin 63 (see FIG. 7) through repetition of the aforementioned printing operation and the supply bobbin 62 (see FIG. 7) is not further rotatable. Therefore, an ink sheet search sensor (not shown) cannot detect an ink sheet printing start position (Y ink sheet) for next printing. In this case, the sublimatic printer 100 prompts the user to exchange the ink sheet cartridge 60 (see FIG. 1).

According to this embodiment, as hereinabove described, the take-up reel 50 includes the reel member 51 provided with the plurality of fragment portions 51*b*, the driving-side gear member 52 fitted with the outer peripheral surfaces 51*c* of the fragment portions 51*b* of the reel member 51 and the coil spring 53 press-fitted with the inner peripheral surfaces 51*d* of the fragment portions 51*b* of the reel member 51 for bringing the fragment portions 51*b* into pressure contact with the driving-side gear member 52, whereby the fragment portions 51*b* can regularly press the driving-side gear member 52 with the prescribed pressing force through the coil spring 53 provided independently of the fragment portions 51*b* without aging in shape, dissimilarly to a case where the fragment portions 51*b* are integrally provided with elastic portions easily aged in shape with time. Therefore, the take-up reel 50 can properly perform torque control on the take-up bobbin 63 while keeping slip torque set in manufacturing.

According to this embodiment, further, the take-up reel 50 includes the reel member 51 provided with the plurality of fragment portions 51*b*, the driving-side gear member 52 fitted with the outer peripheral surfaces 51*c* of the fragment portions 51*b* of the reel member 51 and the coil spring 53 press-fitted with the inner peripheral surfaces 51*d* of the fragment portions 51*b* of the reel member 51 for bringing the fragment portions 51*b* into pressure contact with the driving-side gear member 52, whereby the driving-side gear member 52 performs a sliding operation (rotating operation) with respect to the reel member 51 upon action of the torque limiter function so that the coil spring 53 is not involved in sliding friction (rotating operation) between the driving-side gear member 52 and the reel member 51. In other words, the coil spring 53 causes neither heat generation nor cooling resulting from friction, whereby the elastic force thereof is not aged with time. Therefore, the take-up reel 50 can further properly perform torque control on the take-up bobbin 63 while keeping the slip torque set in manufacturing.

According to this embodiment, in addition, the take-up reel 50 includes the reel member 51 integrally provided with the plurality of fragment portions 51*b* concentrically with the rotation axis thereof, the driving-side gear member 53 fitted with the outer peripheral surfaces 51*c* of the fragment portions 51*b* of the reel member 51 and the coil spring 53 press-fitted with the inner peripheral surfaces 51*e* of the fragment portions 51*c* of the reel member 51 for bringing the fragment portions 51*b* into pressure contact with the driving-side gear member 52, whereby the coil spring 53 can apply the elastic force to circumferentially wide contact regions between the outer peripheral surfaces 51*c* of the fragment portions 51*b* larger in diameter than the rotation axis of the reel member 51 and the inner peripheral surface 52*a* of the driving-side gear member 52 larger in diameter than the fragment portions 51*b* in a direction expanding (the diameter of) the coil spring 53. Thus, the take-up reel 50 can stably operate as a torque limiter dissimilarly to a case of applying the elastic force to small contact regions while reducing the diameter of the coil spring 53. Therefore, the take-up reel 50 can stably take up the ink sheet 61 on the take-up bobbin 63 with proper tensile force.

According to this embodiment, the coil spring 53 is annularly formed and press-fitted with the inner peripheral surfaces 51*d* of the fragment portions 51*b* of the reel member 51 in the state reduced in coil diameter from an unloaded condition, whereby pressing force for outwardly spreading the fragment portions 51*b* of the reel member 51 can be easily obtained through restoring force (elastic energy) of the coil spring 53 restored to the unloaded condition from the state press-fitted with the inner peripheral surfaces 51*d* of the fragment portions 51*b* of the reel member 51.

According to this embodiment, the fragment portions 51*b* of the reel member 51 integrally include the stop portions 51*e* provided on the outer peripheral surfaces 51*c* thereof for inhibiting the driving-side gear member 52 from displacement along arrow P (see FIG. 9), whereby the stop portions 51*e* of the reel member 51 come into contact with the first side surface 52*c* of the driving-side gear member 52 when the driving-side gear member 52 rotates with driving torque exceeding a prescribed level and slips on the outer peripheral surfaces 51*c* of the fragment portions 51*b* of the reel member 51, thereby easily inhibiting the driving-side gear member 52 from dropping from the reel member 51 along arrow P (see FIG. 10).

According to this embodiment, the reel member 51 integrally includes the stop sections 51*f* between the plurality of fragment portions 51*b* thereof for inhibiting the driving-side gear member 52 from displacement along arrow Q (see FIG. 9), whereby the stop sections 51*f* of the reel member 51 come into contact with the second side surface 52*b* of the driving-side gear member 52 when the driving-side gear member 52 rotates with driving torque exceeding the prescribed level and slips on the outer peripheral surfaces 51*c* of the fragment portions 51*b* of the reel member 51, thereby easily inhibiting the driving-side gear member 52 from dropping from the reel member 51 along arrow Q (see FIG. 11).

According to this embodiment, the stop portions 51*e* and the stop sections 51*f* are so arranged as to vertically hold the driving-side gear member 52 along the direction of the rotating axis of the driving-side gear portion 52, whereby the plurality of stop portions 51*e* and the plurality of stop sections 51*f* can reliably rotatably hold the driving-side gear member 52 on the outer peripheral surfaces 51*c* of the fragment portions 51*b* of the reel member 51.

According to this embodiment, the stop portions 51*e* are provided on the outer peripheral surfaces 51*c* of the forward ends of the fragment portions 51*b* to be adjacent to both sides of the stop sections 51*f* so that the stop sections 51*f* and the pairs of stop portions 51*e* adjacent to both sides thereof vertically hold the driving-side gear member 52 on the reel member 51, thereby reliably rotatably holding the driving-side gear member 52 on the reel member 51 with no backlash.

According to this embodiment, the reel member 51 integrally includes the seat portions 51*g* for holding the coil spring 53 between the plurality of fragment portions 51*b* thereof for inhibiting the coil spring 53 from movement along arrow Q (see FIG. 11), whereby the coil spring 53 can be reliably arranged on the inner peripheral surfaces 51*d* of the fragment portions 51*b* of the reel member 51.

According to this embodiment, the reel member 51 integrally includes the protrusions 51*h* provided on the inner peripheral surfaces 51*d* of the forward ends of the fragment portions 51*b* of the reel member 51 for inhibiting the coil spring 53 from displacement along arrow P (see FIG. 9) so that the protrusions 51*h* of the reel member 51 inhibit the coil spring 53 from movement along arrow P (see FIG. 10), whereby the coil spring 53 can be easily inhibited from dropping from the inner peripheral surfaces 51*d* of the fragment portions 51*b* of the reel member 51 along arrow P (see FIG. 10).

According to this embodiment, the protrusions 51*h* and the seat portions 51*g* are so arranged as to vertically hold the coil spring 53 therebetween, whereby the plurality protrusions 51*h* and the plurality of seat portions 51*g* can reliably hold the coil spring 53 on the inner peripheral surfaces 51*d* of the fragment portions 51*b* of the reel member 51.

According to this embodiment, the protrusions 51*h* are provided on the inner peripheral surfaces 51*d* of the forward ends of the fragment portions 51*b* to be adjacent to both sides of the seat portions 51*g* so that the seat portions 51*g* and the pairs of protrusions 51*h* adjacent to both sides thereof can vertically hold the coil spring 53 on the inner peripheral surfaces 51*d* of the fragment portions 51*b*, thereby reliably rotatably holding the coil spring 53 on the inner peripheral surfaces 51*d* of the fragment portions 51*b* with no backlash with respect to the reel member 51.

According to this embodiment, the eight fragment portions 51*b* of the reel member 51 are concentrically arranged at the equiangular interval of 45° while the (four) stop sections 51*f* and the (four) seat portions 51*g* are alternately provided between the fragment portions 51*b* so that the reel member 51 can be concentrically integrally provided with the fragment portions 51*b*, the stop sections 51*f* and the seat portions 51*g* having functions different from each other respectively, whereby the driving-side gear member 52 and the coil spring 53 can be stably arranged on the reel member 51.

According to this embodiment, the reel member 51 is integrally provided with the take-up bobbin engaging portion 51*i* engaging with the take-up bobbin 63 and the driving-side gear member 52 is integrally provided with the gear portion 52*b*, whereby the gear portion 52*b* can easily transmit the driving torque transmitted to the driving-side gear member 52 from the take-up bobbin engaging portion 51*i* of the reel member 51 to the take-up bobbin 63 of the ink sheet cartridge 60.

According to this embodiment, the reel member 51 is integrally provided with the fragment portions 51*b*, the stop portions 51*e*, the stop sections 51*f*, the seat portions 51*g* and the protrusions 51*h* so that the driving-side gear member 52 and the coil spring 53 can be assembled and positioned only through an operation of successively fitting the driving-side gear member 52 and the coil spring 53 with the reel member 51, whereby the take-up reel 50 can be easily assembled.

According to this embodiment, the sublimatic printer 100 comprises the chassis 1 of sheet metal and the motor bracket 12 for fixing the stepping motor 13 while the support shaft 51*j* and the connecting portion 51*k* of the reel member 51 are rotatably inserted into the bearing 12*a* of the motor bracket 12 concentric with the rotation axis of the reel member 51 and the receiving hole 1*e* of the chassis 1 also concentric with the rotation axis of the reel member 51 respectively so that the reel member 51 is rotatably supported with respect to the motor bracket 12 and the chassis 1 on the two positions of the support shaft 51*j* and the connecting portion 51*k* having the same rotation axis, whereby the reel member 51 can rotate with no axial runout.

According to this embodiment, the bearing 12*a* of the motor bracket 12 is formed by burring to cylindrically protrude from the surface of the motor bracket 12 so that the length of the bearing 12*a* can be increased due to the burring, thereby more reliably rotatably supporting the reel member 51 with respect to the motor bracket 12.

According to this embodiment, the receiving hole 1*e* of the chassis 1 is formed by burring to have an inner side surface cylindrically protruding from the surface of the chassis 1 so that the length of the inner side surface of the receiving hole 1*e* can be increased due to the burring, thereby more reliably rotatably supporting the reel member 51 with respect to the chassis 1.

According to this embodiment, the reel member 51 is so formed that the end surface 51*l* connecting the support shaft 51*j* and the shaft portion 51*a* with each other comes into contact with the portion of the side surface of the motor bracket 12 close to the bearing 12*a* thereby controlling movement of the reel member 51 toward a first side so that the reel member 51 rotates while the end surface 51*l* is in contact with the side surface of the motor bracket 12, whereby the reel member 51 can be inhibited from deviating in the direction of the rotation axis.

According to this embodiment, the reel member 51 is so formed that the end surface 51*m* connecting the connecting portion 51*k* and the fragment portions 51*b* with each other comes into contact with the portion of the first side surface 1*a* of the chassis 1 close to the receiving hole 1*e* so that the reel member 51 rotates while the end surface 51*m* is in contact with the first side surface 1*a* of the chassis 1, whereby the reel member 51 can be inhibited from deviating in the direction of the rotation axis.

Although the present invention has been described and illustrated in detail, it is clearly understood that the same is by way of illustration and example only and is not to be taken by way of limitation, the spirit and scope of the present invention being limited only by the terms of the appended claims.

For example, while the aforementioned embodiment is applied to the sublimatic printer 100 employed as an exemplary image generating apparatus, the present invention is not restricted to this but is also applicable to another image generating apparatus other than the sublimatic printer so far as the image generating apparatus comprises a driving source for transporting an ink sheet of an ink sheet cartridge.

While the coil spring 53 is press-fitted with the inner peripheral surfaces 51*d* of the fragment portions 51*b* of the reel member 51 as a spring member in the take-up reel 50 in the aforementioned embodiment, the present invention is not restricted to this but a spring member, annularly formed by rounding a flat plate of metal, for example, other than the coil spring 53 may alternatively be press-fitted with the inner peripheral surfaces 51*d* of the fragment portions 51*b* of the reel member 51.

While the eight fragment portions 51*b* of the reel member 51 are provided at the equiangular interval of 45° in the aforementioned embodiment, the present invention is not restricted to this but the fragment portions 51*b* of the reel member 51 may not be provided at the equiangular interval, and the number thereof may not be eight.

While the four stop sections 51*f*, the four seat portions 51*g* and the four protrusions 51*h* of the reel member 51 are provided at the equiangular intervals respectively in the aforementioned embodiment, the present invention is not restricted to this but the stop sections 51*f*, the seat portions 51*g* and the protrusions 51*h* may not be provided at the equiangular intervals, and the numbers thereof may not be four.

While both of the reel member 51 and the driving-side gear member 52 constituting the take-up reel 50 are made of resin in the aforementioned embodiment, the present invention is not restricted to this but the take-up reel 50 may alternatively be constituted of members of a material, such as metal, for example, other than resin.

What is claimed is:

1. An image generating apparatus comprising:

a driving source transporting an ink sheet of an ink sheet cartridge; and a take-up reel transmitting the driving force of said driving source to a take-up bobbin of said ink sheet cartridge and taking up said ink sheet on said take-up bobbin, wherein said take-up reel includes:

a reel member, integrally provided with a plurality of fragment portions concentrically with a rotation axis thereof, engaging with said take-up bobbin, a driving-side gear member fitted with outer peripheral surfaces of said fragment portions of said reel member toward a second side from a first side, and a spring member press-fitted with inner peripheral surfaces of said fragment portions of said reel member thereby bringing said fragment portions into pressure contact with said driving-side gear member, wherein said reel member integrally has a stop section provided between said plurality of fragment portions of said reel member for inhibiting said driving-side gear member from displacement toward the second side.

2. The image generating apparatus according to claim 1, wherein said spring member is an annular coil spring, and said spring member is press-fitted with the inner peripheral surfaces of said fragment portions of said reel member in a state reduced in coil diameter from an unloaded condition.

3. The image generating apparatus according to claim 1, wherein said fragment portions of said reel member integrally have stop portions provided on the outer peripheral surfaces of the forward ends of said fragment portions for inhibiting said driving-side gear member from displacement toward a first side.

4. The image generating apparatus according to claim 1, wherein said reel member integrally has stop portions provided on the outer peripheral surfaces of the forward ends of said fragment portions of said reel member for inhibiting said driving-side gear member from displacement toward a first side and a stop section provided between said plurality of fragment portions of said reel member for inhibiting said driving-side gear member from displacement toward a second side, and said stop portions and said stop section are so arranged as to vertically hold said driving-side gear member therebetween along the direction of the rotation axis of said driving-side gear member.

5. The image generating apparatus according to claim 4, wherein said stop portions are provided on the outer peripheral surfaces of the forward ends of said fragment portions to be adjacent to both sides of said stop section.

6. The image generating apparatus according to claim 1, wherein said reel member integrally has a seat portion provided between said plurality of fragment portions of said reel member for holding said spring member.

7. The image generating apparatus according to claim 1, wherein said reel member integrally has a protrusion provided on the inner peripheral surfaces of the forward ends of said fragment portions of said reel member for inhibiting said spring member from displacement toward a first side.

8. The image generating apparatus according to claim 1, wherein said reel member integrally has a protrusion provided on the inner peripheral surfaces of the forward ends of said fragment portions of said reel member for inhibiting said spring member from displacement toward a first side and a seat portion for holding said spring member, and said protrusion and said seat portion are so arranged as to vertically hold said spring member therebetween.

9. The image generating apparatus according to claim 8, wherein said protrusion is provided on the inner peripheral surfaces of said fragment portions to be adjacent to both sides of said seat portion.

10. The image generating apparatus according to claim 1, wherein said reel member integrally has a protrusion provided on the inner peripheral surfaces of the forward ends of said fragment portions of said reel member for inhibiting said spring member from displacement toward a first side and a seat portion for holding said spring member, and said plurality of fragment portions of said reel member are concentrically arranged in a prescribed angular range, and a stop section and said seat portion are alternately arranged between said fragment portions.

11. The image generating apparatus according to claim 1, wherein said reel member integrally has a take-up bobbin engaging portion engaging with said take-up bobbin, and said driving-side gear member integrally has a driving-side gear portion.

12. The image generating apparatus according to claim 1, further comprising:

a chassis of sheet metal, and a bracket member for fixing said driving source, wherein said reel member has a shaft portion provided with a support shaft on a first end and a connecting portion provided in the vicinity of a second end opposite to said first end for connecting said shaft portion and said fragment portions with each other, and said support shaft of said reel member is rotatably inserted into a bearing of said bracket member provided concentrically with the rotation axis of said reel member while said connecting portion of said reel member is rotatably inserted into a receiving hole of said chassis provided concentrically with the rotation axis of said reel member.

13. The image generating apparatus according to claim 12, wherein said bearing of said bracket member is formed by burring to cylindrically protrude from the surface of said bracket member.

14. The image generating apparatus according to claim 12, wherein said receiving hole of said chassis is formed by burring to have an inner side surface cylindrically protruding from the surface of said chassis.

15. The image generating apparatus according to claim 12, wherein said support shaft of said reel member has a diameter smaller than the diameter of said shaft portion, and said reel member is so formed that a first end surface portion connecting said support shaft and said shaft portion with each other comes into contact a portion of the side surface of said bracket member close to said bearing thereby controlling movement of said reel member toward a first side.

16. The image generating apparatus according to claim 12, wherein said connecting portion of said reel member has a diameter smaller than the diameter of said fragment portions, and said reel member is so formed that a second end surface portion connecting said connecting portion and said fragment portions with each other comes into contact with a portion of the side surface of said chassis close to said receiving hole thereby controlling movement of said reel member toward a second side.

* * * * *